US010088769B2

(12) United States Patent
Yoshikawa et al.

(10) Patent No.: US 10,088,769 B2
(45) Date of Patent: Oct. 2, 2018

(54) CORONA DISCHARGE DEVICE AND IMAGE FORMATION APPARATUS INCLUDING THE SAME

(71) Applicant: Sharp Kabushiki Kaisha, Osaka (JP)

(72) Inventors: Yoshihiro Yoshikawa, Osaka (JP); Yuhsuke Yoshimoto, Osaka (JP); Takeshi Nishiyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/590,226

(22) Filed: May 9, 2017

(65) Prior Publication Data

US 2017/0343917 A1 Nov. 30, 2017

(30) Foreign Application Priority Data

May 25, 2016 (JP) ..... 2016-104261

(51) Int. Cl.
*G03G 15/02* (2006.01)

(52) U.S. Cl.
CPC ..... *G03G 15/0225* (2013.01); *G03G 15/0291* (2013.01)

(58) Field of Classification Search
CPC ..... G03G 15/0225
See application file for complete search history.

(56) References Cited

U.S. PATENT DOCUMENTS

2013/0136486 A1* 5/2013 Yoneda ..... G03G 15/0291 399/100
2015/0147083 A1* 5/2015 Uenishi ..... G03G 15/0258 399/100

FOREIGN PATENT DOCUMENTS

JP 2012-118308 6/2012

* cited by examiner

*Primary Examiner* — Clayton E Laballe
*Assistant Examiner* — Jas Sanghera
(74) *Attorney, Agent, or Firm* — Renner Otto Boisselle & Sklar, LLP

(57) ABSTRACT

A corona discharge device including a corona electrode provided with multiple sharpened tip portions in a row includes a cleaning member which cleans the tip portions of the corona electrode while reciprocating along a predetermined movement direction set in advance with the tip portions biting into the cleaning member. A cleaning position at a surface of the cleaning member is different in a direction intersecting a longitudinal direction of the corona electrode between when the cleaning member moves toward one side in the movement direction and when the cleaning member moves toward another side in the movement direction.

12 Claims, 16 Drawing Sheets

CORONA DISCHARGE DEVICE AND IMAGE FORMATION APPARATUS INCLUDING THE SAME

BACKGROUND

1. Field

The present disclosure relates to a corona discharge device for performing corona discharge using a corona electrode provided with multiple sharpened tip portions in a row, and an electrophotographic image formation apparatus including the corona discharge device, such as a copier, a multifunction printer, or a printer.

2. Description of the Related Art

Corona discharge type corona discharge devices to be used in an electrophotographic image formation apparatus include one which performs corona discharge from a corona electrode provided with multiple sharpened tip portions (for example, serrated tip portions) in a row.

In such a corona discharge device, a deposition, such as a discharge product or toner, deposits on tip portions of a corona electrode as discharge time lengthens. This results in a decrease in discharge performance (for example, charging performance).

As an example of a configuration which cleans tip portions of a corona electrode, Japanese Unexamined Patent Application Publication No. 2012-118308 discloses a configuration which cleans tip portions of a corona electrode with two cleaning members provided on two sides of the corona electrode.

The configuration disclosed in Japanese Unexamined Patent Application Publication No. 2012-118308, however, uses the two cleaning members and is complicated.

In this respect, use of a cleaning member which cleans tip portions of a corona electrode while reciprocating along a longitudinal direction of the corona electrode with the tip portions biting into the cleaning member is conceivable. In this case, the use of the single cleaning member leads to a simple configuration. However, since a cleaning position at a surface of the cleaning member is the same in a direction intersecting a longitudinal direction of the corona electrode for when the cleaning member moves toward one side in a movement direction and when the cleaning member moves toward the other side in the movement direction, the cleaning performance of the cleaning member for the corona electrode deteriorates in a short period of time.

It is desirable to provide a corona discharge device including a corona electrode provided with multiple sharpened tip portions in a row, the corona discharge device being capable of maintaining the cleaning performance of a cleaning member for the corona electrode for a long period of time with a simple configuration, and an image formation apparatus including the corona discharge device.

SUMMARY

To address the above-described problems, according to an aspect of the present disclosure, there is provided a corona discharge device including a corona electrode provided with multiple sharpened tip portions in a row, and a cleaning member which cleans the tip portions of the corona electrode while reciprocating along a predetermined movement direction set in advance with the tip portions biting into the cleaning member, in which a cleaning position at a surface of the cleaning member is different in a direction intersecting a longitudinal direction of the corona electrode between when the cleaning member moves toward one side in the movement direction and when the cleaning member moves toward another side in the movement direction. Further, according to an aspect of the present disclosure, there is provided an image formation apparatus including a corona discharge device according to the present disclosure.

BRIEF DESCRIPTION OF THE DRAWINGS

FIG. 5A is a plan view, FIG. 5B is a right side view, FIG. 5C is a front view, and FIG. 5D is a back view;

FIG. 6A is a left side view, and FIG. 6B is a bottom view;

FIG. 12A is a schematic plan view illustrating a state where the cleaning roller is rotating and cleaning tip portions in the corona electrode while moving toward one side in a movement direction, and FIG. 12B is a schematic plan view illustrating a state where the cleaning roller is rotating and cleaning the tip portions in the corona electrode while moving toward the other side in the movement direction;

FIG. 14A is a schematic plan view illustrating a state where the cleaning roller is rotating and cleaning tip portions in the corona electrode while moving toward one side in a movement direction, and FIG. 14B is a schematic plan view illustrating a state where the cleaning roller is rotating and cleaning the tip portions in the corona electrode while moving toward the other side in the movement direction;

DESCRIPTION OF THE EMBODIMENTS

A case where a corona discharge device according to the present disclosure is applied to a charging device will be described below as an example with reference to the drawings.

(Overall Configuration of Image Formation Apparatus)

Figure 1:
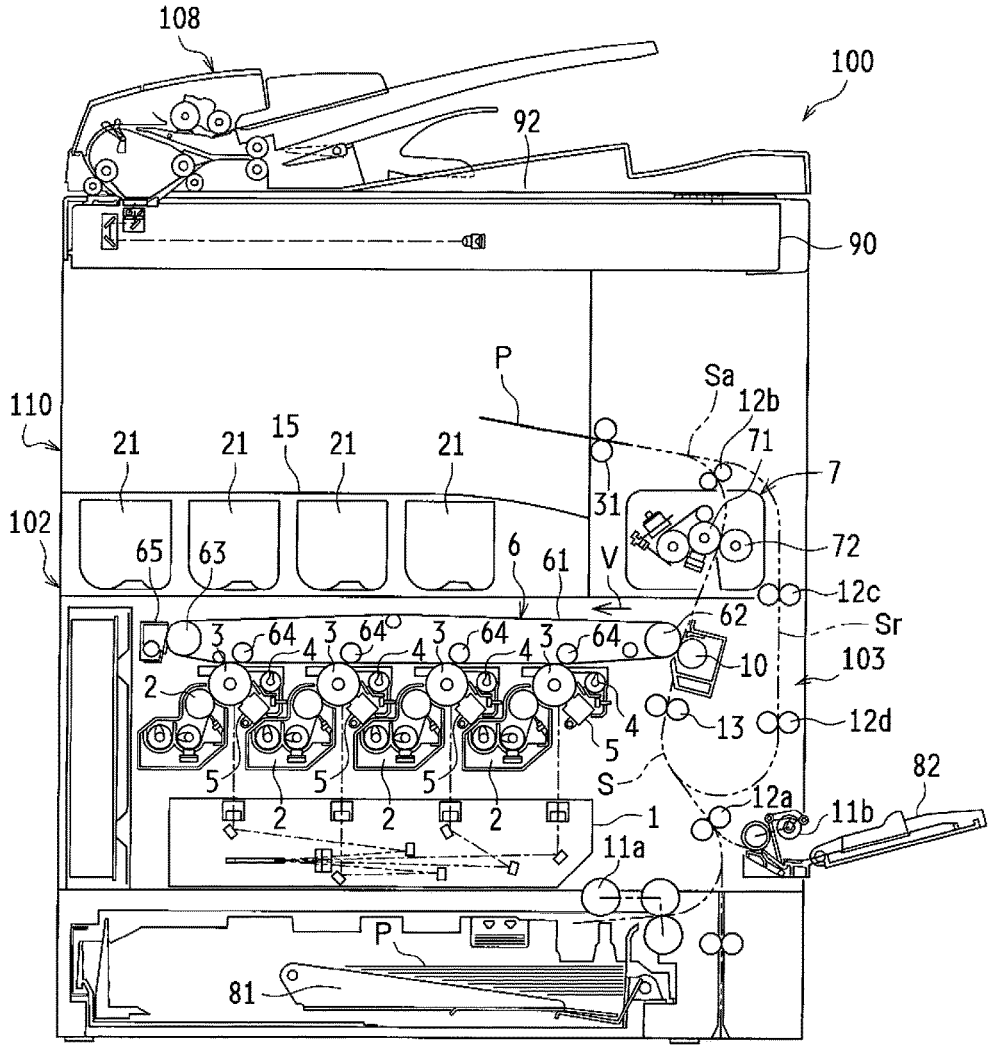
FIG. 1 is a schematic cross-sectional view of an image formation apparatus according to an embodiment of the present disclosure as viewed from the front.

FIG. 1 is a schematic cross-sectional view of an image formation apparatus 100 according to an embodiment of the present disclosure as viewed from the front.

The image formation apparatus 100 illustrated in FIG. 1 is an electrophotographic image formation apparatus using corona discharge. In the present example, the image formation apparatus 100 is a color image formation apparatus which forms a multicolor or unicolor image on a sheet P (for example, a recording paper sheet in the example) in accordance with image data transmitted from the outside.

The image formation apparatus 100 includes an original reading device 108 and an image formation apparatus body 110. The image formation apparatus body 110 is provided with an image formation portion 102 and a sheet conveyance system 103.

The image formation portion 102 includes an exposure unit 1, a plurality of developing units 2, a plurality of photosensitive drums 3 which act as electrostatic latent image carriers, a plurality of cleaning portions 4, a plurality of charging devices 5 (examples of a corona charging device), an intermediate transfer belt unit 6, a plurality of toner cartridge units 21, and a fixing unit 7.

The sheet conveyance system 103 includes a paper feed tray 81, a manual paper feed tray 82, and a copy receiving tray 15.

An original glass plate 92 made of transparent glass, on which an original (not illustrated) is to be placed, is provided above the image formation apparatus body 110, and an optical unit 90 for reading an original is provided underneath the original glass plate 92. The original reading device 108 is provided above the original glass plate 92. The original reading device 108 automatically conveys an original onto the original glass plate 92. The original reading device 108 is pivotably attached to the image formation apparatus body 110 so as to open from the front. An original can be manually placed by making a space on the original glass plate 92 open.

The original reading device 108 can read an automatically conveyed original or an original placed on the original glass plate 92. An image of an original read by the original reading device 108 is fed as image data to the image formation apparatus body 110, and an image which is formed on the basis of the image data by the image formation apparatus body 110 is recorded on a sheet P.

Image data to be treated in the image formation apparatus 100 corresponds to a color image using a plurality of colors (colors of black (K), cyan (C), magenta (M), and yellow (Y) in the example). Thus, the numbers of developing units 2, photosensitive drums 3, cleaning portions 4, charging devices 5, and toner cartridge units 21 are set to two or more (four in the example: black, cyan, magenta, and yellow) such that a plurality of types (four types in the example) of images corresponding to the respective colors are formed. The plurality of sets of components constitute a plurality of (four in the example) image stations.

The charging devices 5 act as chargers for uniformly charging surfaces of the photosensitive drums 3 to a predetermined potential.

The exposure unit 1 exposes the charged photosensitive drums 3 in accordance with input image data, thereby forming electrostatic latent images corresponding to the image data on the surfaces of the respective photosensitive drums 3.

The toner cartridge units 21 are units which store toner and are configured to supply toner to developer tanks of the developing units 2. In the image formation apparatus body 110, toner supplied from the toner cartridge units 21 to the developer tanks of the developing units 2 is controlled such that the toner concentration of a developer in each development tank is steady.

The developing units 2 visualize electrostatic latent images formed on the respective photosensitive drums 3 with four colors (Y, M, C, and K) of toner. The cleaning portions 4 remove and collect toner left on the surfaces of the photosensitive drums 3 after development and image transfer.

The intermediate transfer belt unit 6 disposed above the photosensitive drums 3 includes an intermediate transfer belt 61 which acts as an intermediate transfer body, an intermediate transfer belt driving roller 62, an intermediate transfer belt driven roller 63, a plurality of intermediate transfer rollers 64, and an intermediate transfer belt cleaning unit 65.

Four intermediate transfer rollers 64 are provided corresponding to the colors of Y, M, C, and K. The intermediate transfer belt driving roller 62 together with the intermediate transfer belt driven roller 63 and the intermediate transfer rollers 64 causes the intermediate transfer belt 61 to stretch across the rollers. When the intermediate transfer belt 61 is rotationally driven, the intermediate transfer belt 61 is made to circle and move in a circling direction V. With the movement, the intermediate transfer belt driven roller 63 and the intermediate transfer rollers 64 are driven and rotated.

A transfer bias for transferring toner images formed on the photosensitive drums 3 onto the intermediate transfer belt 61 is applied to each intermediate transfer roller 64.

The intermediate transfer belt 61 is provided so as to be in contact with the photosensitive drums 3. Toner images of the respective colors formed on the photosensitive drums 3 are sequentially transferred onto the intermediate transfer belt 61 such that the toner images are laid on top of one another, thereby forming a color toner image (multicolor toner image) on a surface of the intermediate transfer belt 61.

Transfer of toner images from the photosensitive drums 3 onto the intermediate transfer belt 61 is performed by the intermediate transfer rollers 64 that are in contact with a back side of the intermediate transfer belt 61. A high-voltage transfer bias (specifically, a high voltage of a polarity (+) opposite to the charging polarity (−) of toner) is applied to the intermediate transfer rollers 64 for transferring toner images.

As already described above, toner images visualized on the photosensitive drums 3 in accordance with respective hues are stacked on the intermediate transfer belt 61. Circling movement of the intermediate transfer belt 61 causes the toner images stacked on the intermediate transfer belt 61 to be transferred onto a sheet P by a transfer roller 10 which is disposed at a position of contact between a sheet P and the intermediate transfer belt 61 and constitutes a secondary transfer mechanism portion.

At this time, a voltage for transferring toner onto a sheet P (specifically, a high voltage of a polarity (+) opposite to the charging polarity (−) of toner) is applied to the transfer roller 10 in a state where a transfer nip is formed between the transfer roller 10 and the intermediate transfer belt 61. A transfer nip is formed between the transfer roller 10 and the intermediate transfer belt 61 when the transfer roller 10 and the intermediate transfer belt driving roller 62 are brought into pressure contact with each other. At the time of transfer of a toner image from the intermediate transfer belt 61 onto a sheet P by the transfer roller 10, toner left on the intermediate transfer belt 61 without being transferred onto the sheet P is removed and collected by the intermediate transfer belt cleaning unit 65.

The paper feed tray 81 is a tray where a sheet P, on which an image is to be formed (printed), is stored in advance and is provided below the exposure unit 1 in the image formation apparatus body 110. A sheet P, on which an image is to be formed (printed), is placed on the manual paper feed tray 82.

The copy receiving tray 15 is provided above the image formation portion 102 in the image formation apparatus body 110, and image-formed (image-printed) sheets P are piled up face-down on the copy receiving tray 15.

The image formation apparatus body 110 is provided with a sheet conveyance path S for feeding a sheet P fed from the paper feed tray 81 and the manual paper feed tray 82 to the copy receiving tray 15 via the transfer roller 10 and the fixing unit 7. Near the sheet conveyance path S, pick-up rollers 11*a* and 11*b*, a plurality of (first to fourth in the example) conveyance rollers 12*a* to 12*d*, paper stop rollers 13, the transfer roller 10, a heat roller 71 and a pressure roller 72 in the fixing unit 7, and delivery rollers 31 are disposed.

The first to fourth conveyance rollers 12*a* to 12*d* are small rollers for facilitating and assisting with conveyance of a sheet P. The first and second conveyance rollers 12*a* and 12*b* are provided along the sheet conveyance path S, and the third and fourth conveyance rollers 12*c* and 12*d* are provided on an inverted conveyance path Sr which branches off from the sheet conveyance path S at a branched portion Sa. The pick-up roller 11*a* is provided near a sheet supply side of the paper feed tray 81, and picks up sheets P one by one from the paper feed tray 81 and supplies the sheets P to the sheet conveyance path S. Similarly, the pick-up roller 11*b* is provided near a sheet supply side of the manual paper feed tray 82, and picks up sheets P one by one from the manual paper feed tray 82 and supplies the sheets P to the sheet conveyance path S.

The paper stop rollers 13 temporarily hold a sheet P being conveyed on the sheet conveyance path S and then conveys the sheet P to the transfer nip between the transfer roller 10 and the intermediate transfer belt 61 at a predetermined time.

The fixing unit 7 fixes an unfixed toner image to a sheet P and includes the heat roller 71 and the pressure roller 72 that act as fixing rollers.

When the image formation apparatus 100 with the above-described configuration is requested to perform one-side printing on a sheet P, the image formation apparatus 100 supplies a sheet P from the paper feed tray 81 or the manual paper feed tray 82 and conveys the sheet P to the paper stop rollers 13 by the first conveyance rollers 12*a* that are provided along the sheet conveyance path S. The image formation apparatus 100 then conveys the sheet P with the transfer roller 10 at a time when alignment of the sheet P with a toner image on the intermediate transfer belt 61 is achieved and transfers the toner image onto the sheet P. After that, unfixed toner on the sheet P is melt and fixed by heat by causing the sheet P to pass through the fixing unit 7, and the sheet P is ejected onto the copy receiving tray 15 via the second conveyance rollers 12*b* and the delivery rollers 31.

The charging devices 5 that act as corona discharge devices will be described below with reference to FIGS. 2 to 17.

(Charging Device)

Figure 2:
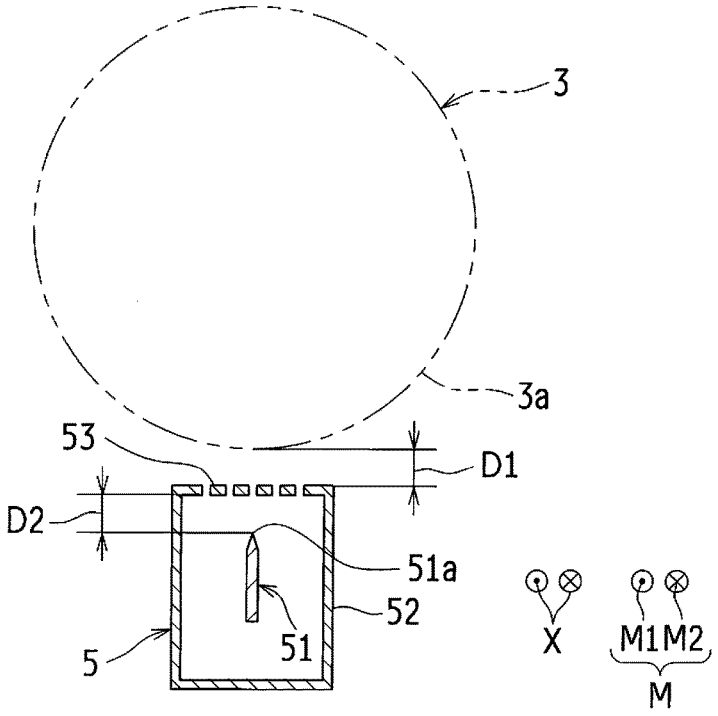
FIG. 2 is a schematic configuration view schematically illustrating a cross-sectional state of a charging device in the image formation apparatus illustrated in FIG. 1.
Figure 3:
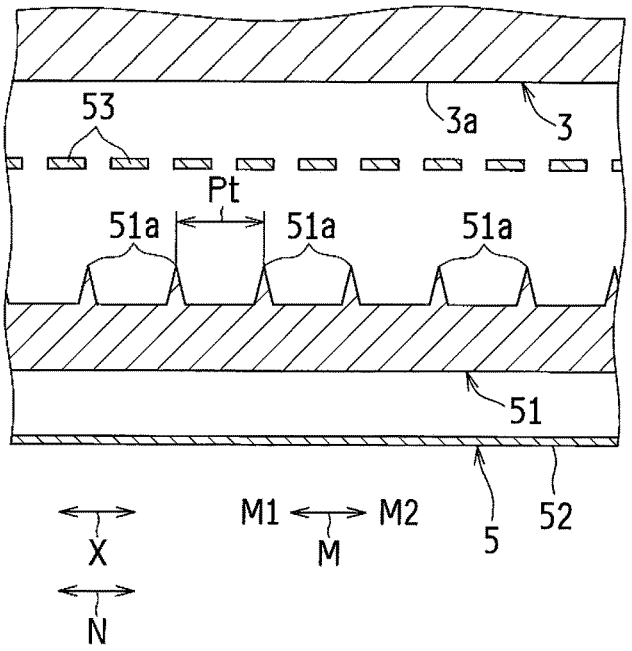
FIG. 3 is a schematic cross-sectional view illustrating, on an enlarged scale, a part of the charging device.
Figure 4:
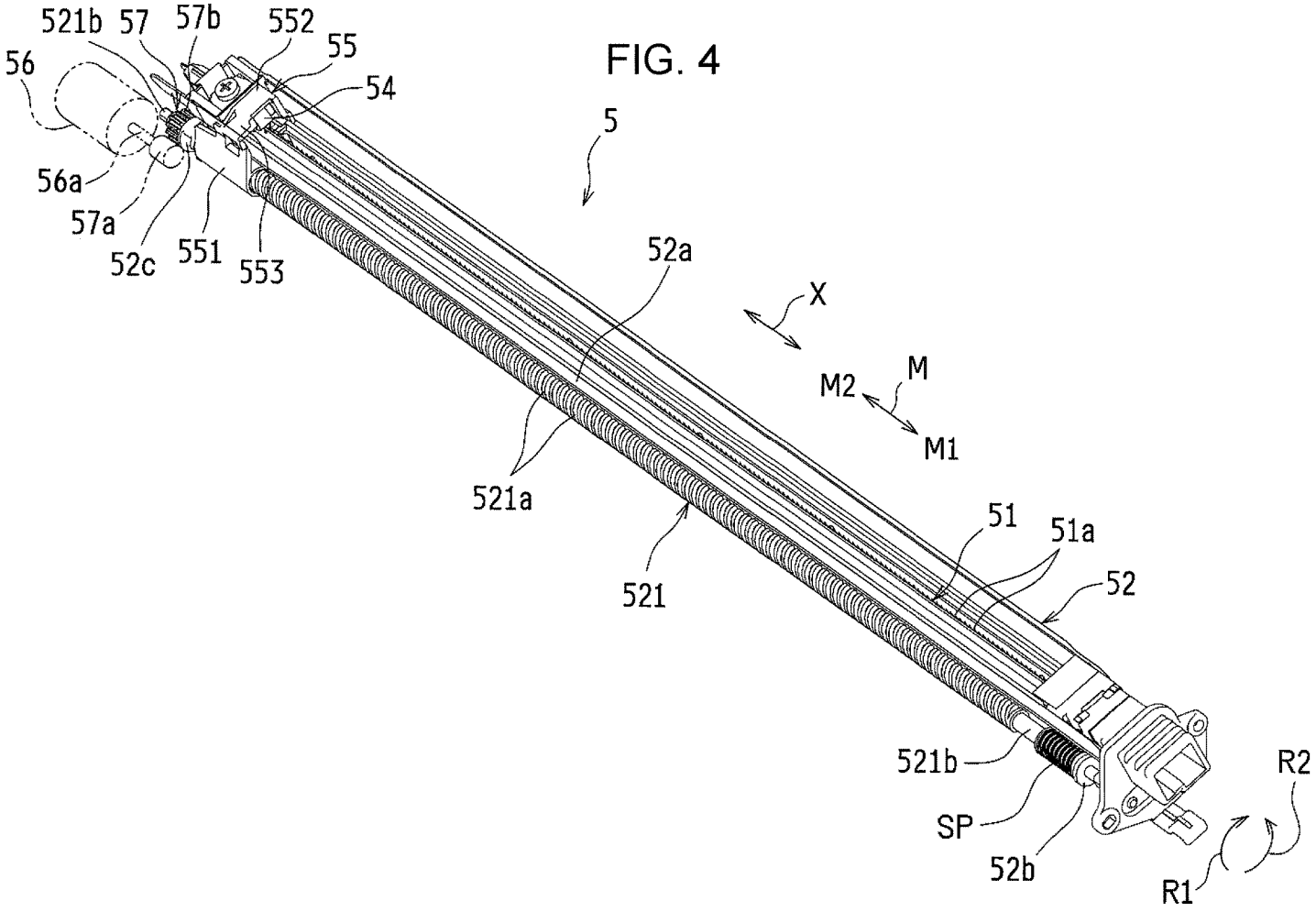
FIG. 4 is a perspective view of the charging device as viewed from obliquely above on a front side.
Figure 5A:
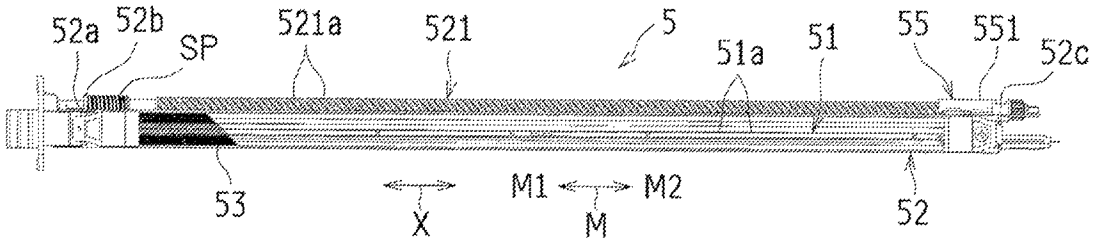
FIGS. 5A to 5D are views illustrating parts of a six-sided view of the charging device.
Figure 5B:
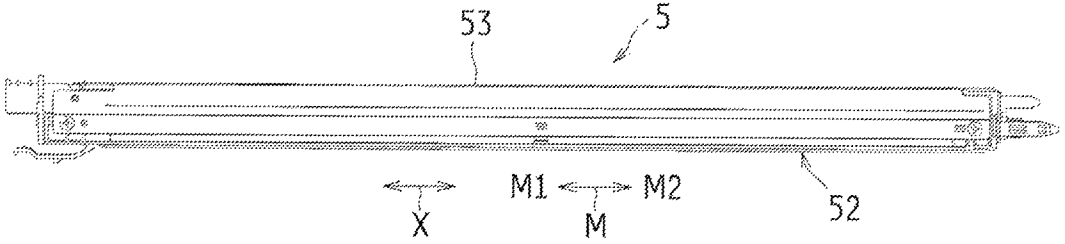
Figure 5D:
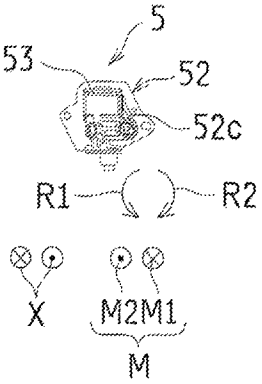
Figure 5C:
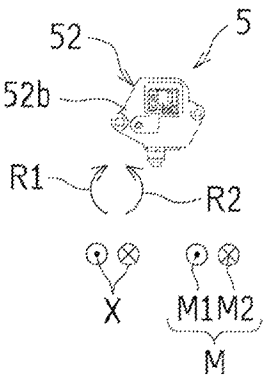
Figure 6A:
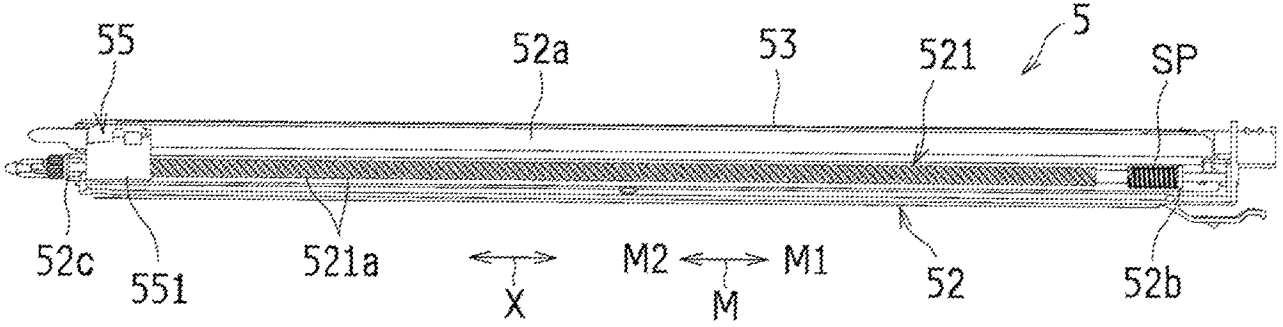
FIGS. 6A and 6B are views illustrating parts of the six-sided view of the charging device.
Figure 6B:
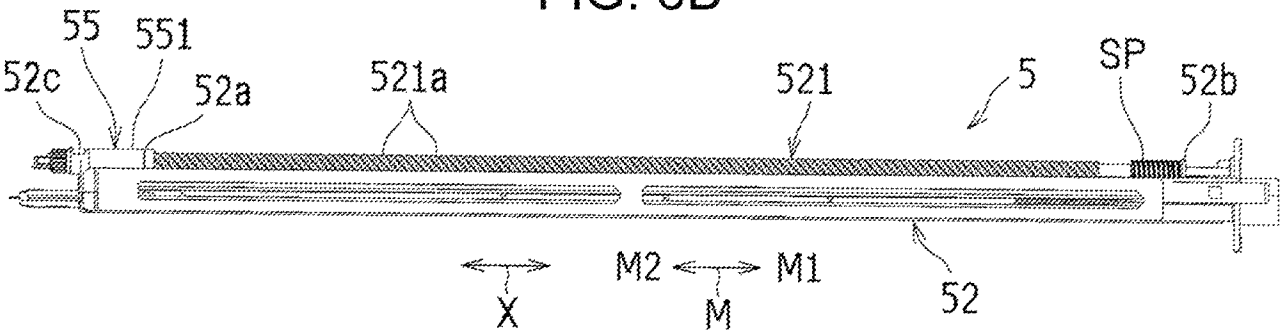

FIG. 2 is a schematic configuration view schematically illustrating a cross-sectional state of the charging device 5 in the image formation apparatus 100 illustrated in FIG. 1. FIG. 3 is a schematic cross-sectional view illustrating, on an enlarged scale, a part of the charging device 5. FIG. 4 is a perspective view of the charging device 5 as viewed from obliquely above on a front side. FIGS. 5A to 5D and 6A and 6B are views illustrating parts of a six-sided view of the charging device 5. FIGS. 5A, 5B, 5C, 5D, 6A, and 6B are a plan view, a right side view, a front view, a back view, a left side view, and a bottom view, respectively, of the charging device 5. A grid electrode 53 is not illustrated in FIG. 4 and FIG. 5C. Note that since the charging devices 5 are all substantially the same, one charging device 5 is illustrated in FIGS. 2 to 6A and 6B. The same applies to FIGS. 7 to 17 (to be described later).

The charging device 5 includes a corona electrode (see FIGS. 2 to 4 and 5A) which is provided with multiple sharpened tip portions 51*a* in a row (see FIGS. 2 to 4 and 5A) and a body portion (specifically, a body case) 52 (see FIGS. 2 to 6A and 6B) which supports the corona electrode 51. In the example, the charging device 5 is of a scorotron type further including the grid electrode 53 (see FIGS. 2, 3, 5A, 5B, 5D, and 6A) that controls a charged potential of a surface 3*a* (see FIGS. 2 and 3) of the photosensitive drum 3 (see FIGS. 2 and 3).

The corona electrode 51 extends parallel or substantially parallel to a rotation axis direction X of the photosensitive drum 3 and is disposed inside the body portion 52. In the example, the corona electrode 51 is an electrode (a so-called serrated electrode or a needle electrode) in which multiple serrated (triangular in side view) tip portions 51*a* are formed along a longitudinal direction N (see FIG. 3) to have a predetermined pitch Pt set in advance (see FIG. 3).

The body portion 52 extends parallel or substantially parallel to the rotation axis direction X of the photosensitive drum 3 and is a box-like member in which a surface on a side facing the photosensitive drum 3 is open. The grid electrode 53 is provided so as to cover an open side of the body portion 52. The corona electrode 51 is provided in the body portion 52 such that the tip portions 51*a* face the surface 3*a* of the photosensitive drum 3 via the grid electrode 53.

Specifically, the body portion 52 is provided to be detachable from the image formation apparatus body 110 such that a spacing D1 (see FIG. 2) between the grid electrode 53 and the surface 3*a* of the photosensitive drum 3 is uniform or substantially uniform along the longitudinal direction N. The corona electrode 51 is fixed to the body portion 52 such that a spacing D2 (see FIG. 2) between the tip portion 51*a* and the grid electrode 53 is uniform or substantially uniform along the longitudinal direction N. With this configuration, the charging device 5 can uniformly cause corona discharge from the corona electrode 51 toward the grid electrode 53 along the longitudinal direction N. The corona electrode 51 can be formed by, for example, etching a metal material (specifically, stainless steel) having a predetermined board thickness (specifically, about 0.1 mm). The corona electrode 51 can be formed, for example, such that a radius of curvature of the tip portion 51*a* is not more than a predetermined value (specifically, about 20 μm).

The grid electrode 53 is configured such that a corona wind generated through corona discharge from the corona electrode 51 is smoothly supplied to the photosensitive drum 3. In the example, the grid electrode 53 is formed into a mesh (see FIG. 5A).

Respective DC voltages are applied to the corona electrode 51 and the grid electrode 53 via a power source (not illustrated) such that a voltage difference set in advance is generated. Specifically, a DC voltage of negative polarity is applied to the corona electrode 51, and a DC voltage of positive polarity is applied to the grid electrode 53. It is thus possible to cause corona discharge between the corona electrode 51 and the grid electrode 53 to generate an electric wind from the corona electrode 51 toward the grid electrode 53 and to stably charge the photosensitive drum 3. The voltage difference set in advance is, for example, −4 kV.

First Embodiment to Fifth Embodiment

The charging device 5 can be configured in the manners illustrated below in first to fifth embodiments. Note that reference characters not described so far in FIGS. 2 to 6A and 6B will be described later.

First Embodiment and Second Embodiment

Figure 7:
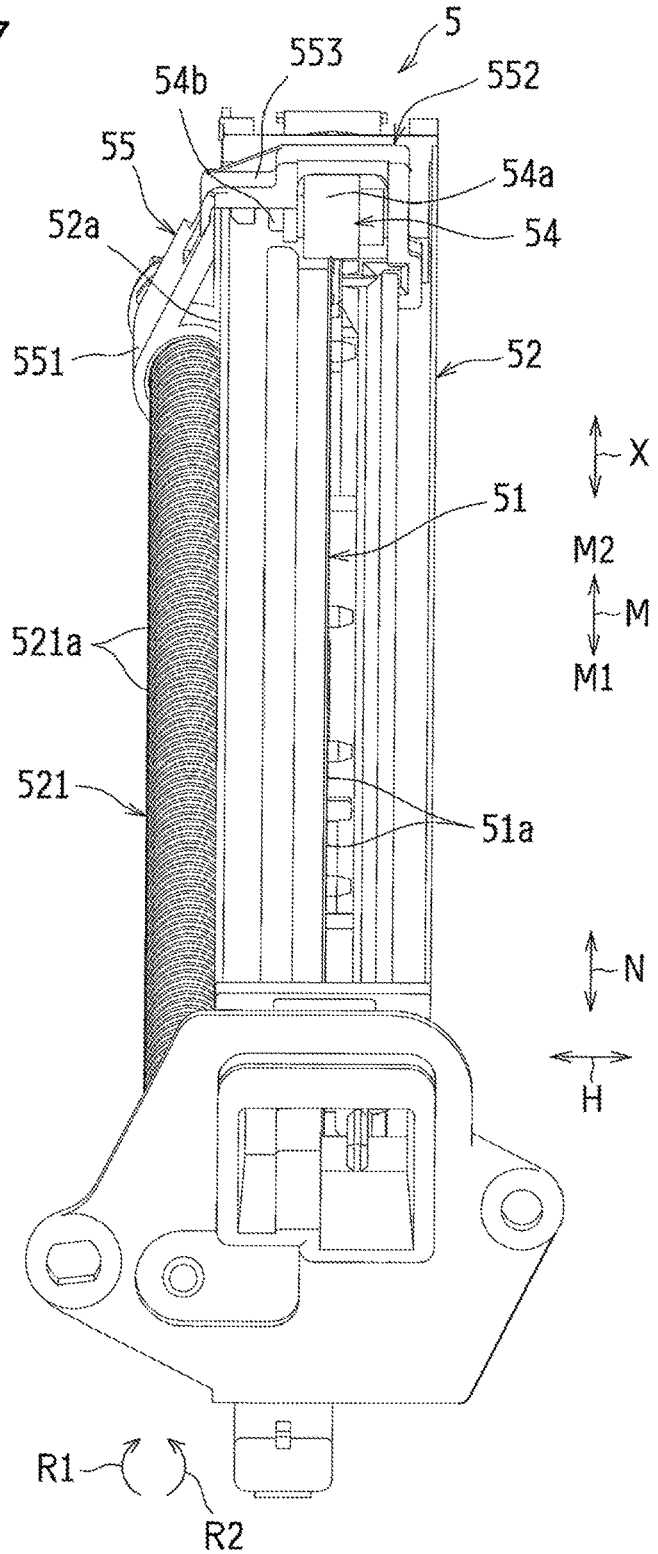
FIG. 7 is a perspective view of a charging device according to a first embodiment as viewed from above on a front side.
Figure 8:
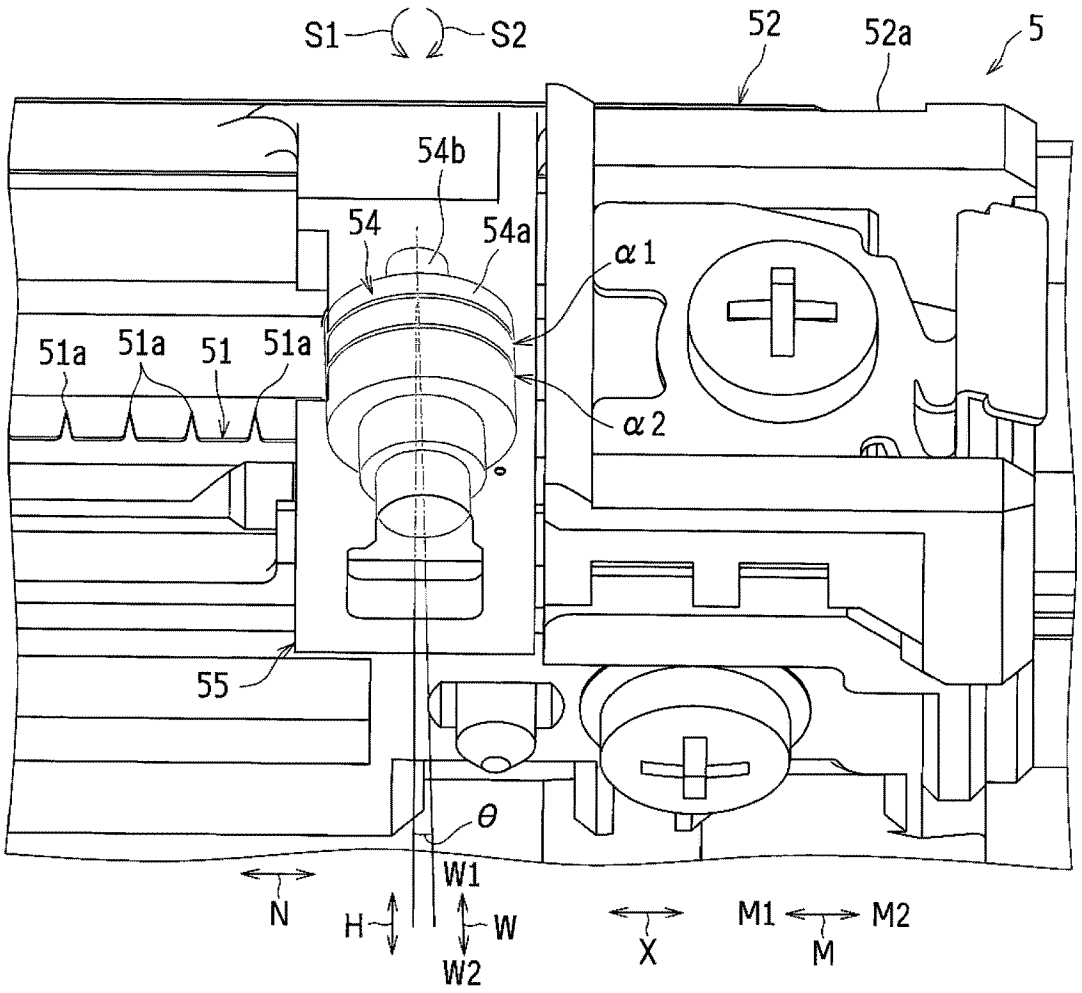
FIG. 8 is a schematic perspective view illustrating, on an enlarged scale, a part with a cleaning roller and a movable holding portion in the charging device according to the first embodiment.
Figure 9:
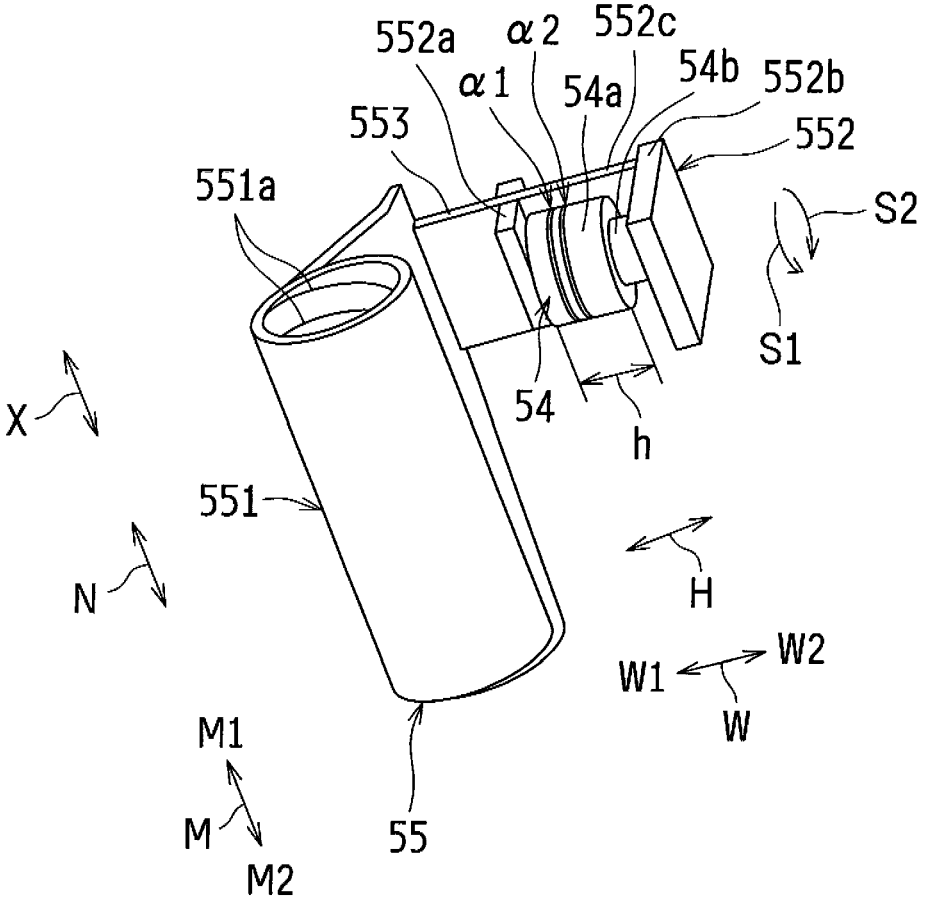
FIG. 9 is a perspective view of the cleaning roller and the movable holding portion in the charging device according to the first embodiment, as viewed from below.
Figure 10:
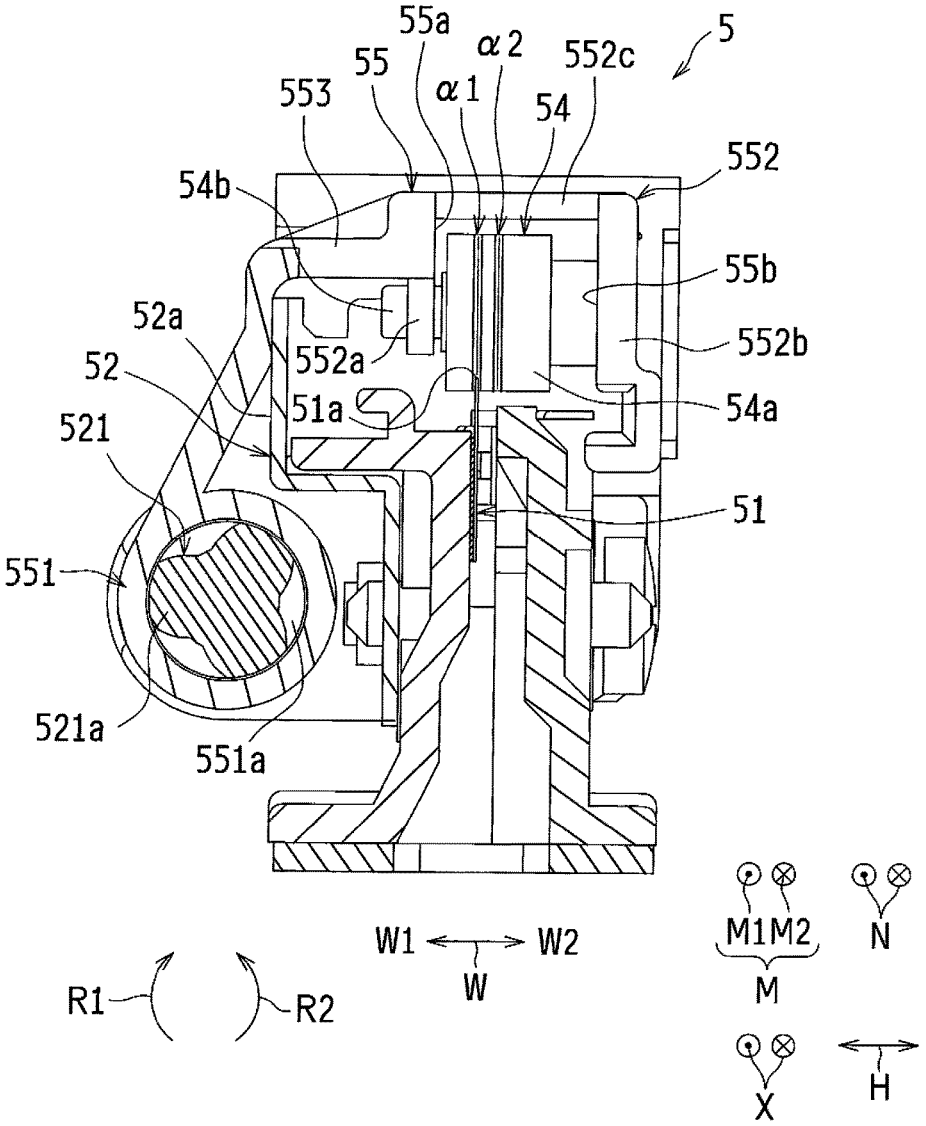
FIG. 10 is a schematic cross-sectional view of the part with the cleaning roller and movable holding portion in the charging device according to the first embodiment and is a view illustrating a state where the cleaning roller is cleaning a corona electrode at a first cleaning position.
Figure 11:
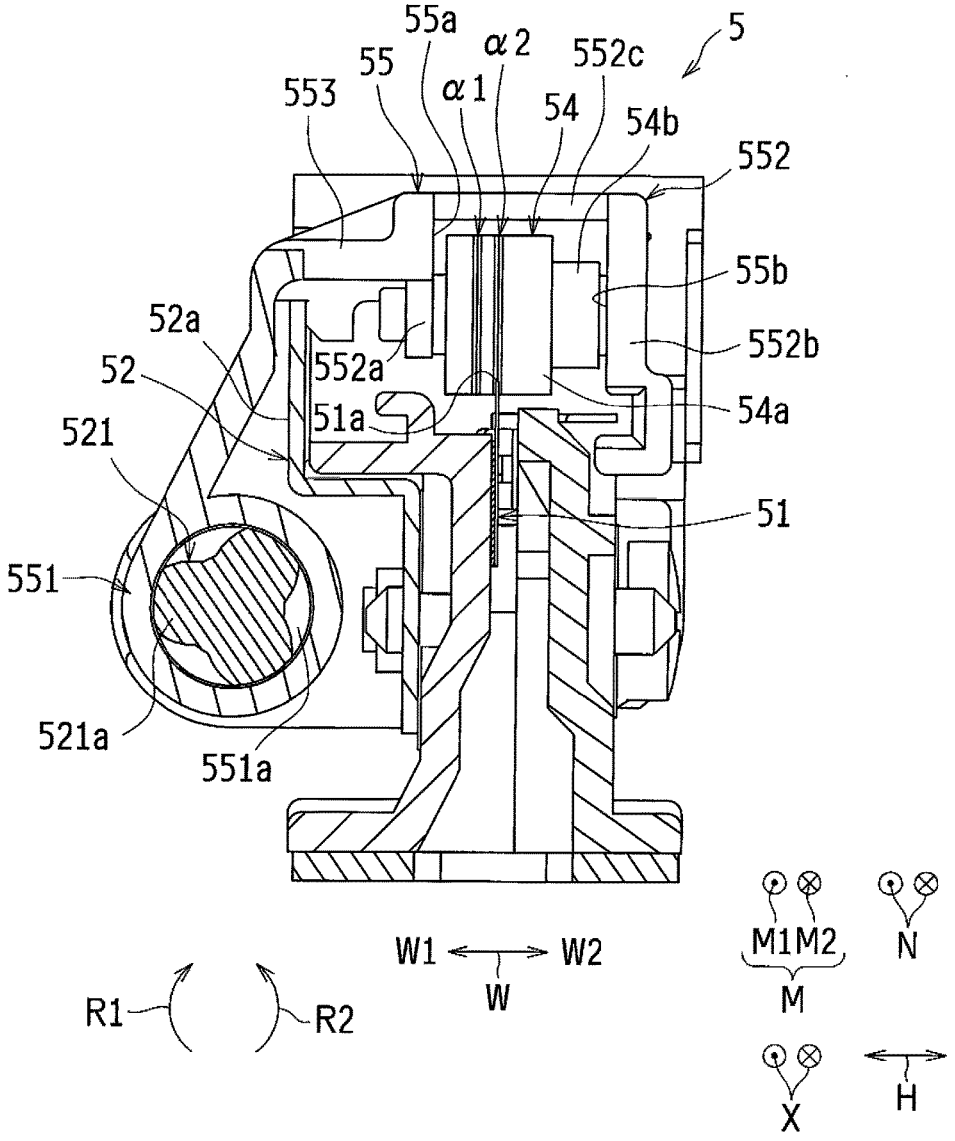
FIG. 11 is a schematic cross-sectional view of the part with the cleaning roller and the movable holding portion in the charging device according to the first embodiment and is a view illustrating a state where the cleaning roller is cleaning the corona electrode at a second cleaning position.
Figure 12A:
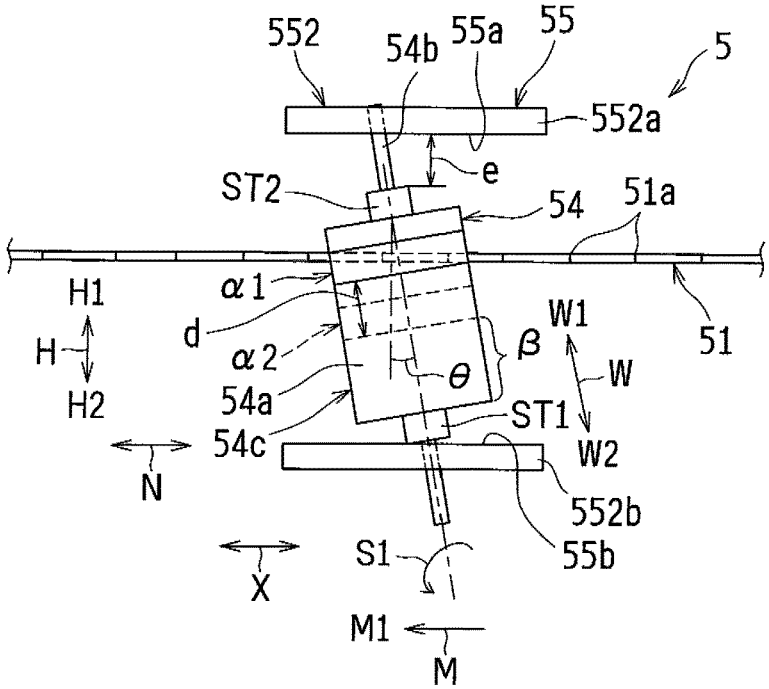
FIGS. 12A and 12B are schematic views illustrating the cleaning roller and the corona electrode in the charging device according to the first embodiment with exaggeration of tilted states of the cleaning roller.
Figure 12B:
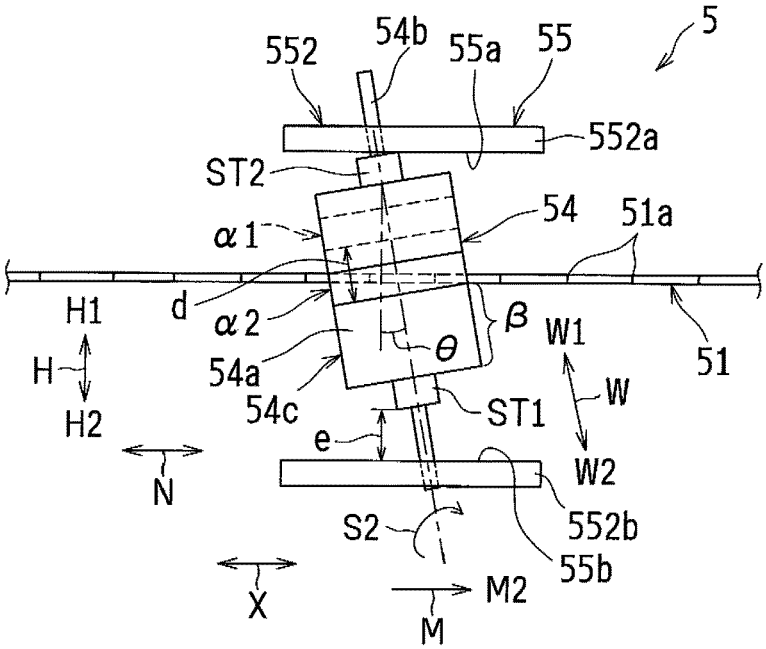

FIG. 7 is a perspective view of a charging device 5 according to a first embodiment as viewed from above on a front side. FIG. 8 is a schematic perspective view illustrating, on an enlarged scale, a part with a cleaning roller 54 and a movable holding portion 55 in the charging device 5 according to the first embodiment. FIG. 9 is a perspective view of the cleaning roller 54 and the movable holding portion 55 in the charging device 5 according to the first embodiment, as viewed from below. FIGS. 10 and 11 are schematic cross-sectional views of the part with the cleaning roller 54 and the movable holding portion 55 in the charging device 5 according to the first embodiment. FIG. 10 illustrates a state where the cleaning roller 54 is cleaning a corona electrode 51 at a first cleaning position α1. FIG. 11 illustrates a state where the cleaning roller 54 is cleaning the corona electrode 51 at a second cleaning position α2. FIGS. 12A and 12B are schematic views illustrating the cleaning roller 54 and the corona electrode 51 in the charging device 5 according to the first embodiment with exaggeration of tilted states of the cleaning roller 54. FIG. 12A is a schematic plan view illustrating a state where the cleaning roller 54 is rotating and cleaning tip portions 51*a* in the corona electrode 51 while moving toward one side M1 in a movement direction M. FIG. 12B is a schematic plan view illustrating a state where the cleaning roller 54 is rotating and cleaning the tip portions 51*a* in the corona electrode 51 while moving toward the other side M2 in the movement direction M.

Figure 13:
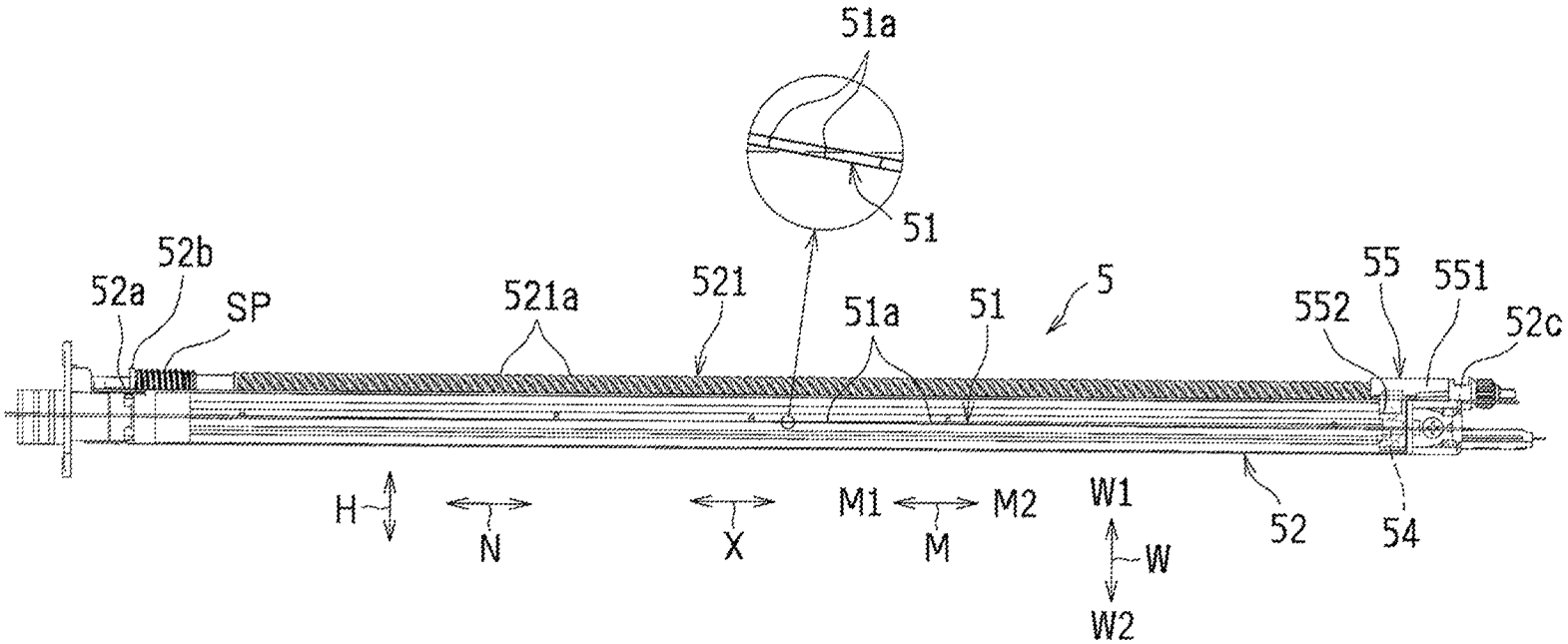
FIG. 13 is a schematic plan view illustrating a charging device according to a second embodiment.
Figure 14A:
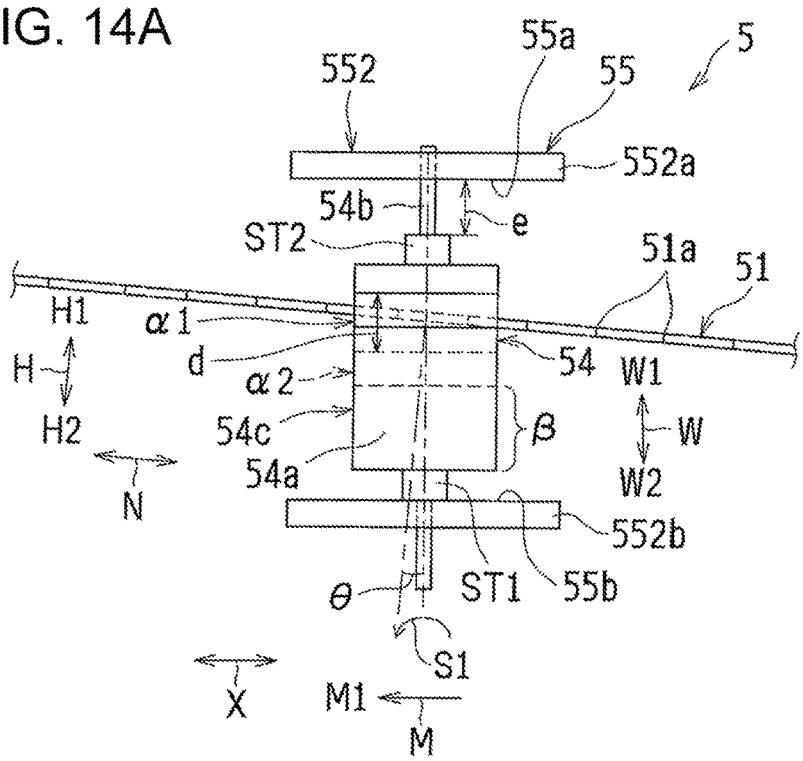
FIGS. 14A and 14B are schematic views illustrating a cleaning roller and a corona electrode in the charging device according to the second embodiment with exaggeration of tilted states of the corona electrode.
Figure 14B:
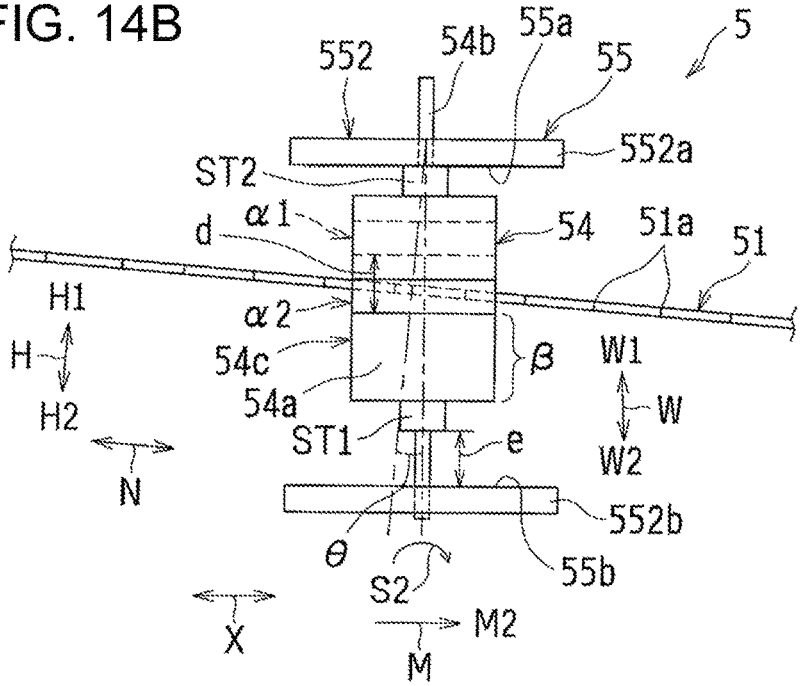

FIG. 13 is a schematic plan view illustrating a charging device 5 according to a second embodiment. FIGS. 14A and 14B are schematic views illustrating a cleaning roller 54 and a corona electrode 51 in the charging device 5 according to the second embodiment with exaggeration of tilted states of the corona electrode 51. FIG. 14A is a schematic plan view illustrating a state where the cleaning roller 54 is rotating and cleaning tip portions 51*a* in the corona electrode 51 while moving toward one side M1 in a movement direction M. FIG. 14B is a schematic plan view illustrating a state where the cleaning roller 54 is rotating and cleaning the tip portions 51*a* in the corona electrode 51 while moving toward the other side M2 in the movement direction M.

The charging device 5 further includes the cleaning roller 54 (an example of a cleaning member) (see FIGS. 7 to 12A and 12B and 14A and 14B) and the movable holding portion 55 (see FIGS. 4, 5A, and 6A and 6B to 14A and 14B). The cleaning roller 54 cleans the tip portions 51*a* (see FIGS. 7, 8, and 10 to 14A and 14B) of the corona electrode 51 (see FIGS. 7, 8, and 10 to 14A and 14B) while reciprocating along the predetermined movement direction M set in advance (a direction parallel or substantially parallel to a rotation axis direction X of a photosensitive drum 3 in the example) with the tip portions 51*a* biting into the cleaning roller 54 (see FIGS. 10 to 12A and 12B and 14A and 14B). The movable holding portion 55 holds the cleaning roller 54 and is provided to be reciprocable along the movement direction M with respect to the body portion 52.

In the present embodiments, the cleaning roller 54 rotates about an axis and cleans the tip portions 51*a* of the corona electrode 51 while reciprocating along the movement direction M with the tip portions 51*a* biting into the cleaning roller 54. Thus, the movable holding portion 55 is configured to hold the cleaning roller 54 such that the cleaning roller 54 is rotatable about the rotation axis.

Specifically, the body portion 52 (FIGS. 7, 8, 10, and 11) is provided with a guide portion 521 (see FIGS. 4, 5A, 6A and 6B, 7, 10, and 11) which guides the movable holding portion 55 such that the movable holding portion 55 is reciprocable in the movement direction M.

Although the charging device 5 may be configured such that the movable holding portion 55 is manually made to reciprocate along the guide portion 521, the charging device 5 is configured in the example such that the movable holding portion 55 is automatically made, by a driving portion 56 (see FIG. 4), to reciprocate along the guide portion 521.

Specifically, the guide portion 521 is a screw member which extends along the movement direction M and has a male-threaded (spiral) engaging portion 521*a* (more specifically, a spiral uneven portion) (see FIGS. 4, 5A, 6A and 6B, 7, 10, and 11) which is formed along one side surface 52*a* (see FIGS. 4, 5A, 6A and 6B to 8, 10, and 11) of the body portion 52 to have a predetermined pitch.

The cleaning roller 54 is cylindrical and is formed of an elastic member (for example, an elastic resin member, such as a rubber member). The number of cleaning rollers 54 is one in the example. Examples of a material which can be used for a roller portion 54*c* (see FIGS. 12A and 12B and 14A and 14B) in the cleaning roller 54 include but are not limited to chloroprene rubber (CR), urethane rubber, nitrile rubber, natural rubber, ethylene propylene rubber, butyl rubber, and silicone. Alternatively, for example, an elastic member containing an abrasive material, such as aluminum oxide (alumina), may be used for the roller portion 54*c*.

The guide portion 521 is provided at the body portion 52 so as to be rotatable about an axis. In the example, the guide portion 521 is supported to be rotatable about the axis by a support portion 52*b* (more specifically, a support plate) (see FIGS. 4, 5A, 5C, and 6A and 6B) which is provided at an end portion on the one side M1 (a near side or an operation side) in the movement direction M of the guide portion 521 and a support portion 52*c* (more specifically, a support plate) (see FIGS. 4, 5A, 5D, and 6A and 6B) which is provided at an end portion on the other side M2 (a far side or a side opposite to the operation side).

The driving portion 56 is configured to transmit a rotational driving force to the guide portion 521 via a driving transmission mechanism 57 (see FIG. 4). In the example, the driving transmission mechanism 57 includes a driving gear 57*a* (see FIG. 4) which is fixed to a rotating shaft 56*a* (see FIG. 4) of the driving portion 56 and a driven gear 57*b* (see FIG. 4) which is fixed to one end portion of a rotating shaft 521*b* (see FIG. 4) of the guide portion 521 and meshes with the driving gear 57*a*.

The movable holding portion 55 includes a tubular portion 551 (see FIGS. 4, 5A, 6A and 6B, 7, 9 to 11, and 13) which has, at an inner peripheral surface, a female-threaded (spiral) locked portion 551*a* (more specifically, a spiral uneven portion) (see FIGS. 9 to 11). Rotation in one rotation direction R1 (see FIGS. 4, 5C, 5D, 7, 10, and 11; a clockwise direction in FIG. 4 in the example) about the axis of the guide portion 521 causes the tubular portion 551 to be guided to the one side M1 in the movement direction M while the locked portion 551*a* is locked onto the engaging portion 521*a* in the guide portion 521. Rotation in the other rotation direction R2 (see FIGS. 4, 5C, 5D, 7, 10, and 11; a counterclockwise direction in FIG. 4 in the example) about the axis of the guide portion 521 causes the tubular portion 551 to be guided to the other side M2 in the movement direction M while the locked portion 551*a* is locked onto the engaging portion 521*a* in the guide portion 521.

The end portion on the one side M1 in the movement direction M of the rotating shaft 521*b* of the guide portion 521 is inserted in a biasing member SP (specifically, a straight type spring) (see FIGS. 4, 5A, and 6A and 6B), which biases the movable holding portion 55 toward the other side M2 in the movement direction M so as not to disengage the locked portion 551*a* in the tubular portion 551 from the engaging portion 521*a* in the guide portion 521 when the movable holding portion 55 moves to an end portion on the one side M1 in the movement direction M. It is thus possible to effectively avoid excessive movement of the movable holding portion 55 toward the one side M1 in the movement direction M due to rotation in the one rotation direction R1 about the axis of the guide portion 521 and easily return the movable holding portion 55 toward the other side M2 in the movement direction M through rotation in the other rotation direction R2 about the axis of the guide portion 521. In the example, the biasing member SP extends between the engaging portion 521*a* in the guide portion 521 and the support portion 52*b*.

Note that reciprocation of the movable holding portion 55 between the end portion on the one side M1 in the movement direction M and the end portion on the other side M2 in the movement direction M by the guide portion 521 is performed with respect to an initial position (a home position; the position of the end portion on the other side M2 in the movement direction M in the example) on the basis of a driving time for the driving portion 56 (specifically, the number of pulses of a pulse signal input to the driving portion 56).

The movable holding portion 55 includes a support portion 552 (see FIGS. 4, 7, and 9 to 14A and 14B) which rotatably supports a rotating shaft 54*b* (see FIGS. 7 to 12A and 12B and 14A and 14B) of the cleaning roller 54 at two end portions in a rotation axis direction W (see FIGS. 8 to 14A and 14B) and a joining portion 553 (see FIGS. 4, 7, and 9 to 11) which joins the support portion 552 and the tubular portion 551. In the example, the support portion 552 includes support plates 552*a* and 552*b* (see FIGS. 9 to 12A and 12B and 14A and 14B) which face each other across the cleaning roller 54 and rotatably support the rotating shaft 54*b* of the cleaning roller 54 and a joining plate 552*c* (see FIGS. 9 to 11) which are orthogonal or substantially orthogonal to the one pair of support plates 552*a* and 552*b* and join the one pair of support plates 552*a* and 552*b*. The joining portion 553 is substantially L-shaped so as to lie across the one side surface 52*a* in the body portion 52 between the support portion 552 and the tubular portion 551.

In each charging device 5 with the above-described configuration, if the driving portion 56 causes the guide portion 521 to rotate in the one rotation direction R1 about the axis, the guide portion 521 moves toward the one side M1 in the movement direction M, and the cleaning roller 54 cleans the tip portions 51*a* of the corona electrode 51 with the tip portions 51*a* biting into the cleaning roller 54. On the other hand, if the driving portion 56 causes the guide portion 521 to rotate in the other rotation direction R2 about the axis, the guide portion 521 moves toward the other side M2 in the movement direction M, and the cleaning roller 54 cleans the tip portions 51*a* of the corona electrode 51 with the tip portions 51*a* biting into the cleaning roller 54.

The charging device 5 is configured such that a cleaning position (a predetermined first cleaning position $\alpha 1$ (see FIGS. 8 to 12A and 12B and 14A and 14B) set in advance and a predetermined second cleaning position $\alpha 2$ (see FIGS. 8 to 12A and 12B and 14A and 14B) set in advance in the rotation axis direction W of the cleaning roller 54 in the example) at a surface 54*a* (cleaning surface) (see FIGS. 7 to 12A and 12B and 14A and 14B) of the cleaning roller 54 is different in a direction intersecting a longitudinal direction N (see FIGS. 7 to 14A and 14B) of the corona electrode 51 between when the cleaning roller 54 moves toward the one side M1 in the movement direction M and when the cleaning roller 54 moves toward the other side M2 in the movement direction M.

According to the present embodiments, the cleaning roller 54 acting as a cleaning member cleans the tip portions 51*a* of the corona electrode 51 while reciprocating along the movement direction M with the tip portions 51*a* biting into the cleaning roller 54. Accordingly, the tip portions 51*a* of the corona electrode 51 can be cleaned using the single cleaning roller 54, which leads to a simple configuration. Additionally, the cleaning position (the first cleaning position $\alpha 1$ and the second cleaning position $\alpha 2$ in the example) at the surface 54*a* of the cleaning roller 54 is different in the direction intersecting the longitudinal direction N of the corona electrode 51 between when the cleaning roller 54 moves toward the one side M1 in the movement direction M and when the cleaning roller 54 moves toward the other side M2 in the movement direction M. Accordingly, a wide area at the surface 54*a* of the cleaning roller 54 can be used when the cleaning roller 54 cleans the corona electrode 51. This allows long-term maintenance of the cleaning performance of the cleaning roller 54 for the corona electrode 51.

Specifically, the cleaning roller 54 rotates and cleans the tip portions 51*a* of the corona electrode 51 while reciprocating along the movement direction M with the tip portions 51*a* biting into the cleaning roller 54.

With the above-described configuration, the whole of an outer periphery of the surface 54*a* can be used as a cleaning portion at the surface 54*a* of the cleaning roller 54 for the corona electrode 51, and the cleaning performance can be maintained for a long time.

The charging device 5 may be configured such that the rotation axis direction W of the cleaning roller 54 and an orthogonal direction H (see FIGS. 7 to 14A and 14B)

orthogonal to the longitudinal direction N of the corona electrode 51 intersect at a predetermined angle θ of inclination in advance (an angle other than 0°, ±90°, and) 180° (see FIGS. 8, 12A and 12B, and 14A and 14B). The charging device 5 may be configured to shift the cleaning position at the surface 54*a* of the cleaning roller 54 toward one side W1 in the rotation axis direction W (see FIGS. 8 to 14A and 14B) (specifically, toward the one side W1 by a predetermined distance d (see FIGS. 12A and 14A)) through rotation of the cleaning roller 54 in one rotation direction S1 (see FIGS. 8, 9, 12A, and 14A) and to shift the cleaning position at the surface 54*a* of the cleaning roller 54 toward the other side W2 in the rotation axis direction W (see FIGS. 8 to 14A and 14B) (specifically, toward the other side W2 by the predetermined distance d (see FIGS. 12B and 14B)) through rotation of the cleaning roller 54 in the other rotation direction S2 (see FIGS. 8, 9, 12B, and 14B). The predetermined distance d has a value smaller than a value of a width h (see FIG. 9) in the rotation axis direction W of the cleaning roller 54.

In the charging device 5 according to the first embodiment illustrated in FIGS. 7 to 12A and 12B, the longitudinal direction N of the corona electrode 51 may be parallel or substantially parallel to the movement direction M, and the rotation axis direction W of the cleaning roller 54 may be tilted with respect to the movement direction M.

The above-described configuration allows implementation of support of the corona electrode 51 by the body portion 52 with a simple configuration.

In the charging device 5 according to the second embodiment illustrated in FIGS. 13 and 14A and 14B, the longitudinal direction N of the corona electrode 51 may be inclined with respect to the movement direction M, and the rotation axis direction W of the cleaning roller 54 may be at right angles or substantially at right angles to the movement direction M.

The above-described configuration allows implementation of holding of the cleaning roller 54 by the movable holding portion 55 with a simple configuration.

Specifically, the charging devices 5 according to the first and second embodiments illustrated in FIGS. 7 to 14A and 14B are each configured such that the cleaning roller 54 shifts freely along the rotation axis direction W with respect to the corona electrode 51. The rotating shaft 54*b* of the cleaning roller 54 is rotatably supported by the movable holding portion 55 in a state where a predetermined spacing e set in advance (so-called play) (see FIGS. 12A and 12B and 14A and 14B) is provided between each of a first regulation portion 55*a* (an inner side surface of the support plate 552*a* in the example; see FIGS. 10 to 12A and 12B and 14A and 14B) and a second regulation portion 55*b* (an inner side surface of the support plate 552*b*; see FIGS. 10 to 12A and 12B and 14A and 14B) on two sides in the movable holding portion 55 and a roller portion 54*c* in the cleaning roller 54. With this configuration, the cleaning roller 54 can be reliably shifted toward both the one side W1 and the other side W2 in the rotation axis direction W by the movable holding portion 55. In the example, a first depressed portion ST1 and a second depressed portion ST2 (see FIGS. 12A and 12B and 14A and 14B) which are formed by reducing diameters on two outer sides in the rotation axis direction W of the roller portion 54*c* are provided on the two sides in the rotation axis direction W in terms of reducing an area of contact between the roller portion 54*c* and each of the first regulation portion 55*a* and the second regulation portion 55*b*.

As illustrated in FIGS. 7 to 14A and 14B, the charging devices 5 according to the first and second embodiments may each be configured such that the cleaning roller 54 is held by the movable holding portion 55 so as to be shiftable along the rotation axis direction W and such that the corona electrode 51 is fixed. The present disclosure, however, is not limited to this. The charging devices 5 may be configured such that the corona electrode 51 is supported by the body portion 52 so as to be shiftable along the orthogonal direction H and such that the cleaning roller 54 is rotatable about the axis and is fixed or substantially fixed in the rotation axis direction W.

Specifically, in the charging device 5, a base end portion (not illustrated) which is provided to be orthogonal or substantially orthogonal to the corona electrode 51 can be provided at the body portion 52 via a low-frictional-resistance member (not illustrated), such as a rolling member (specifically, a ball or a roller), to be slidable in the orthogonal direction H. With this configuration, the corona electrode 51 can be reliably shifted toward both one side H1 (see FIGS. 12A and 12B and 14A and 14B) and the other side H2 (see FIGS. 12A and 12B and 14A and 14B) in the orthogonal direction H by the body portion 52.

In each of the charging devices 5 according to the first and second embodiments described above, when the cleaning roller 54 moves toward the one side M1 in the movement direction M, the cleaning roller 54 rotates in the one rotation direction S1 in oblique contact with the corona electrode 51 (that is, with the tip portions 51*a* of the corona electrode 51 biting obliquely into the surface 54*a* of the cleaning roller 54) along with the movement toward the one side M1.

In this case, in a configuration where the cleaning roller 54 shifts along the rotation axis direction W with respect to the corona electrode 51 and the corona electrode 51 is fixed, the cleaning roller 54 shifts toward the other side W2 (an upstream side on the one side M1 in the movement direction M where the angle θ of inclination is formed) in the rotation axis direction W, and the shift toward the other side W2 in the rotation axis direction W then stops at the first cleaning position α1 (see FIGS. 10, 12A, and 14A) under regulation by a regulation portion (the second regulation portion 55*b* on the other side of the movable holding portion 55 in the examples illustrated in FIGS. 7 to 14A and 14B) which regulates a shift to the other side W2. With this configuration, the cleaning roller 54 can clean the tip portions 51*a* of the corona electrode 51 at the first cleaning position α1.

Although not illustrated, in a configuration where the corona electrode 51 shifts along the orthogonal direction H with respect to the cleaning roller 54 and the cleaning roller 54 is fixed or substantially fixed in the rotation axis direction W, the corona electrode 51 shifts toward the one side H1 (a downstream side on the one side M1 in the movement direction M where the angle θ of inclination is formed) in the orthogonal direction H, and the shift toward the one side H1 in the orthogonal direction H then stops at the first cleaning position α1 under regulation by a regulation portion (the first regulation portion on the one side of the body portion 52 not illustrated) which regulates a shift toward the one side H1. With this configuration, the cleaning roller 54 can clean the tip portions 51*a* of the corona electrode 51 at the first cleaning position α1.

When the cleaning roller 54 moves toward the other side M2 in the movement direction M, the cleaning roller 54 rotates in the other rotation direction S2 in oblique contact with the corona electrode 51 (that is, with the corona electrode 51 biting obliquely into the surface 54*a* of the cleaning roller 54) along with the movement toward the other side M2.

In this case, in the configuration where the cleaning roller 54 shifts along the rotation axis direction W with respect to the corona electrode 51 and the corona electrode 51 is fixed, the cleaning roller 54 shifts toward the one side W1 (an upstream side on the other side M2 in the movement direction M where the angle θ of inclination is formed) in the rotation axis direction W, and the shift toward the one side W1 in the rotation axis direction W stops at the second cleaning position α2 (see FIGS. 11, 12B, and 14B) different from the first cleaning position α1 under regulation by the regulation portion (the first regulation portion 55*a* on the one side of the movable holding portion 55 in the examples illustrated in FIGS. 7 to 14A and 14B) that regulates a shift toward the one side W1. With this configuration, the cleaning roller 54 can clean the tip portions 51*a* of the corona electrode 51 at the second cleaning position α2.

Although not illustrated, in the configuration where the corona electrode 51 shifts along the orthogonal direction H with respect to the cleaning roller 54 and the cleaning roller 54 is fixed or substantially fixed in the rotation axis direction W, the corona electrode 51 shifts toward the other side H2 (a downstream side on the other side M2 in the movement direction M where the angle θ of inclination is formed) in the orthogonal direction H, and the shift toward the other side H2 in the orthogonal direction H then stops at the second cleaning position α2 under regulation by the regulation portion (the second regulation portion on the other side of the body portion 52 not illustrated) that regulates a shift toward the other side H2. With this configuration, the cleaning roller 54 can clean the tip portions 51*a* of the corona electrode 51 at the second cleaning position α2.

It is thus possible to simply and easily implement a configuration where the cleaning position (α1 and α2) at the surface 54*a* of the cleaning roller 54 is different in the direction intersecting the longitudinal direction N of the corona electrode 51 between when the cleaning roller 54 moves toward the one side M1 in the movement direction M and when the cleaning roller 54 moves toward the other side M2 in the movement direction M.

The angle θ of inclination according to each of the first and second embodiments can be set to an angle which allows the cleaning roller 54 to reliably clean the corona electrode 51 and allows a smooth shift to different cleaning positions (α1 and α2) at the surface 54*a* of the cleaning roller 54. The angle θ of inclination according to the first embodiment depends on the width h of the cleaning roller 54, and the like. The angle θ of inclination according to the first embodiment is preferably, but not limited to, about not less than 1° and not more than 5°, more preferably about not less than 1° and not more than 3°. The angle θ of inclination is set to about 2° in the example. The angle θ of inclination according to the second embodiment depends on the length of the corona electrode 51, and the like. The angle θ of inclination is preferably, but not limited to, about not less than 0.1° and not more than 0.5°, more preferably about not less than 0.1° and not more than 0.3°. The angle θ of inclination is set to about 0.2° in the example.

Third Embodiment and Fourth Embodiment

Although the cleaning performance of the cleaning roller 54 for the corona electrode 51 can be increased with an increase in the hardness of the cleaning roller 54, the problem of bending of the tip portions 51*a* (sharpened portions) of the corona electrode 51 is more likely to occur. In this case, the durability of the corona electrode 51 to be cleaned by the cleaning roller 54 decreases. This is prominent especially if the hardness of the cleaning roller 54 becomes higher due to an environmental change (for example, a low-temperature environment). Although the durability of the corona electrode 51 to be cleaned by the cleaning roller 54 can be increased with a decrease in the hardness of the cleaning roller 54, the problem of damage to the cleaning roller 54 is more likely to occur. In this case, the cleaning performance of the cleaning roller 54 for the corona electrode 51 decreases.

It is thus desirable to achieve both improvement in the durability of the corona electrode 51 to be cleaned by the cleaning roller 54 and improvement in the cleaning performance of the cleaning roller 54 for the corona electrode 51.

Figure 15:
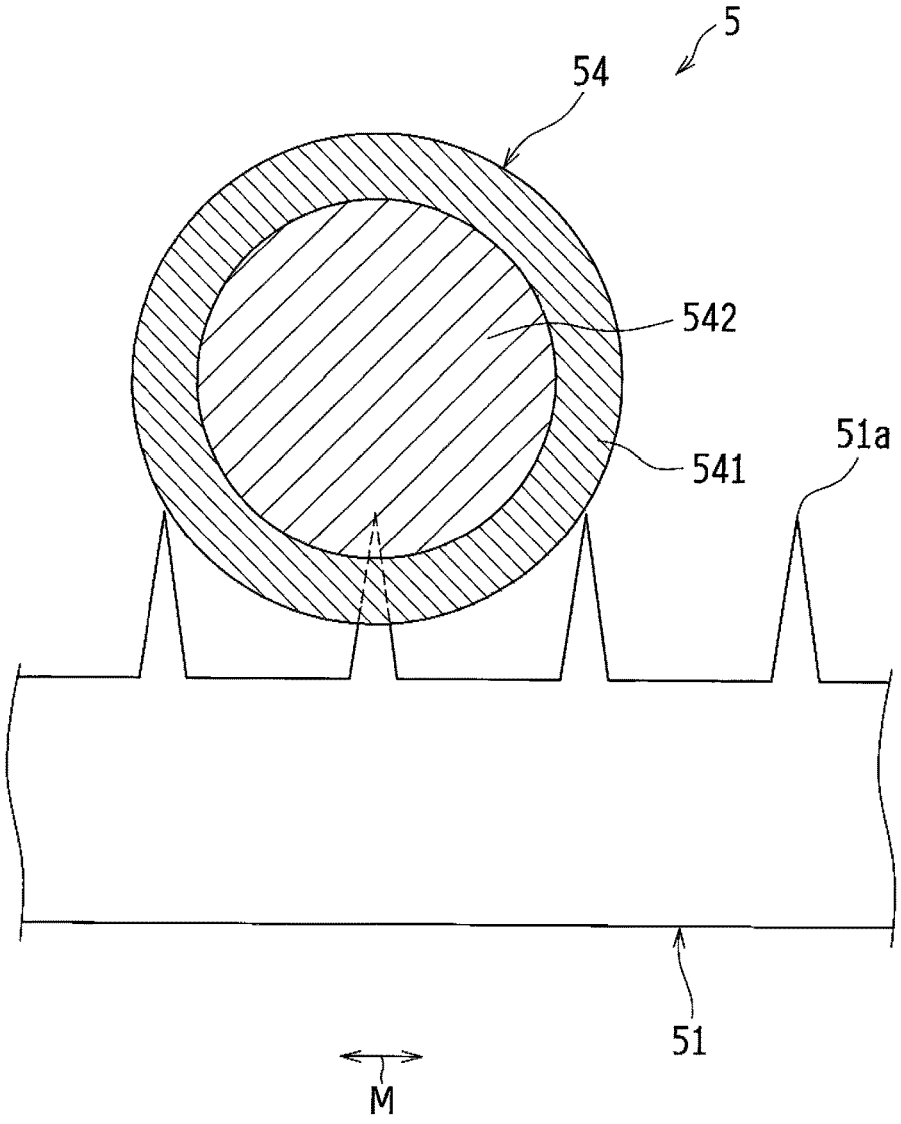
FIG. 15 is a schematic cross-sectional view schematically illustrating the inner configuration of a cleaning roller in a charging device according to a third embodiment.
Figure 16:
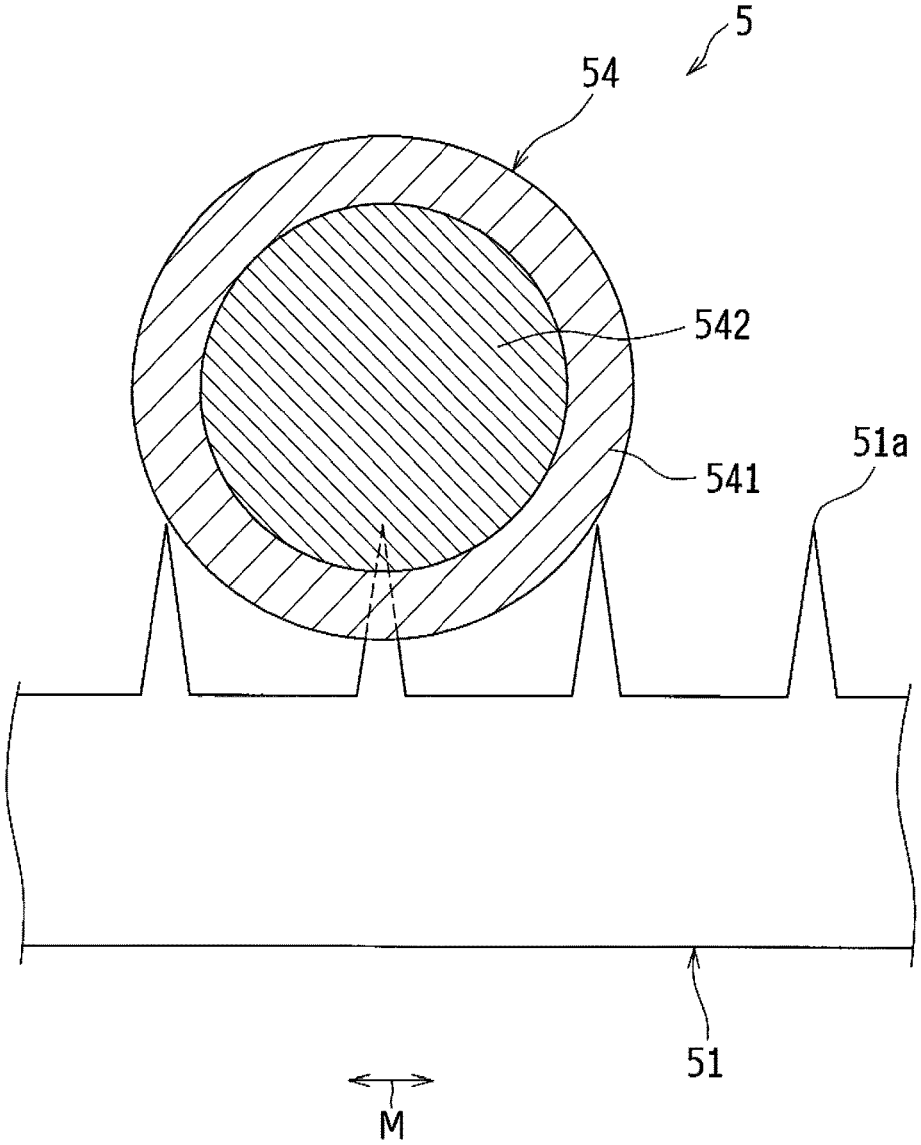
FIG. 16 is a schematic cross-sectional view schematically illustrating the inner configuration of a cleaning roller in a charging device according to a fourth embodiment.

FIG. 15 is a schematic cross-sectional view schematically illustrating the inner configuration of a cleaning roller 54 in a charging device 5 according to a third embodiment. FIG. 16 is a schematic cross-sectional view schematically illustrating the inner configuration of a cleaning roller 54 in a charging device 5 according to a fourth embodiment.

As illustrated in FIGS. 15 and 16, in each of the third and fourth embodiments, the cleaning roller 54 has a structure with two layers, and one of the two layers is different in hardness from the other.

With the above-described configuration, each charging device 5 can have both the advantage that the cleaning performance of the cleaning roller 54 for a corona electrode 51 is improved when the hardness of the cleaning roller 54 is increased and the advantage that the durability of the corona electrode 51 to be cleaned by the cleaning roller 54 is improved when the hardness of the cleaning roller 54 is decreased. It is thus possible to achieve both improvement in the durability of the corona electrode 51 to be cleaned by the cleaning roller 54 and improvement in the cleaning performance of the cleaning roller 54 for the corona electrode 51.

The same components in the third and fourth embodiments as those in the first and second embodiments are denoted by the same reference characters, and a description of the components will be omitted.

In the third and fourth embodiments, examples of a material which can be used for a roller portion 54*c* in the cleaning roller 54 include but are not limited to chloroprene rubber (CR) (with a hardness of, for example, about 15 to 90 degrees), urethane rubber (with a hardness of, for example, about 25 to 100 degrees), nitrile rubber (with a hardness of, for example, about 20 to 95 degrees), natural rubber (with a hardness of, for example, about 20 to 90 degrees), ethylene propylene rubber (with a hardness of, for example, about 20 to 80 degrees), butyl rubber (with a hardness of, for example, about 20 to 70 degrees), and silicone (with a hardness of, for example, about 10 to 90 degrees). Alternatively, for example, an elastic resin member containing an abrasive material, such as aluminum oxide (alumina), may be used for the roller portion 54*c*. Different materials may be used for a low-hardness layer and a high-hardness layer or different hardnesses may be achieved by a single material.

Third Embodiment

In the third embodiment illustrated in FIG. 15, an outer layer 541 of two layers is a high-hardness layer, and an inner layer 542 is a low-hardness layer.

With the above-described configuration, when tip portions 51*a* of the corona electrode 51 enters into the outer layer 541 as the high-hardness layer, the tip portions 51*a* can be cleaned with the outer layer 541 as the high-hardness layer. Since the outer layer 541 is the high-hardness layer, the cleaning performance of the cleaning roller 54 for the corona electrode 51 can be improved. Since the inner layer 542 is the low-hardness layer, the inner layer 542 as the low-hardness layer can be elastically deformed. It is thus possible to inhibit the problem of the tip portion 51*a* (a sharpened portion) of the corona electrode 51 bending due to the outer layer 541 as the high-hardness layer and in turn improve the durability of the corona electrode 51 to be cleaned by the cleaning roller 54. This is effective especially if the hardness of the cleaning roller becomes higher due to an environmental change (for example, a low-temperature environment).

Note that the thickness and hardness of the outer layer 541 and those of the inner layer 542 can be appropriately set to achieve both improvement in the durability of the corona electrode 51 and improvement in the cleaning performance of the cleaning roller 54.

As for the above-described configuration, the cleaning roller 54 may be configured so as to rotate and clean the tip portions 51*a* of the corona electrode 51 while reciprocating along a movement direction M with the tip portions 51*a* biting into only the high-hardness outer layer 541. Alternatively, the cleaning roller 54 may be configured so as to rotate and clean the tip portions 51*a* of the corona electrode 51 while reciprocating along the movement direction M with the tip portions 51*a* biting into the low-hardness inner layer 542, as illustrated in FIG. 15.

If the tip portions 51*a* of the corona electrode 51 are configured to bite into the low-hardness inner layer 542, the tip portions 51*a* can be further cleaned with the inner layer 542 as the low-hardness layer, and the cleaning performance of the cleaning roller 54 for the corona electrode 51 can be further improved.

Fourth Embodiment

In the fourth embodiment illustrated in FIG. 16, an outer layer 541 of two layers is a low-hardness layer, and an inner layer 542 is a high-hardness layer.

With the above-described configuration, when tip portions 51*a* of the corona electrode 51 enter into the outer layer 541 as the low-hardness layer, the tip portions 51*a* can be cleaned with the outer layer 541 as the low-hardness layer. Since the outer layer 541 is a low-hardness layer, it is possible to inhibit the problem of the tip portion 51*a* (a sharpened portion) of the corona electrode 51 bending due to the outer layer 541 as the low-hardness layer and in turn improve the durability of the corona electrode 51 to be cleaned by the cleaning roller 54. This is effective especially if the hardness of the cleaning roller 54 becomes higher due to an environmental change (for example, a low-temperature environment). Since the inner layer 542 is a high-hardness layer, damage to the cleaning roller 54 can be inhibited, which allows improvement in the cleaning performance of the cleaning roller 54 for the corona electrode 51.

Note that the thickness and hardness of the outer layer 541 and those of the inner layer 542 can be appropriately set to achieve both improvement in the durability of the corona electrode 51 and improvement in the cleaning performance of the cleaning roller 54.

As for the above-described configuration, the cleaning roller 54 may be configured so as to rotate and clean the tip portions 51*a* of the corona electrode 51 while reciprocating along a movement direction M with the tip portions 51*a* biting into only the low-hardness outer layer 541. Alternatively, the cleaning roller 54 may be configured so as to rotate and clean the tip portions 51*a* of the corona electrode 51 while reciprocating along the movement direction M with the tip portions 51*a* biting into the high-hardness inner layer 542, as illustrated in FIG. 16.

If the tip portions 51*a* of the corona electrode 51 are configured to bite into the high-hardness inner layer 542, the tip portions 51*a* can be further cleaned with the inner layer 542 as the high-hardness layer, and the cleaning performance of the cleaning roller 54 for the corona electrode 51 can be further improved.

Fifth Embodiment

Figure 17:
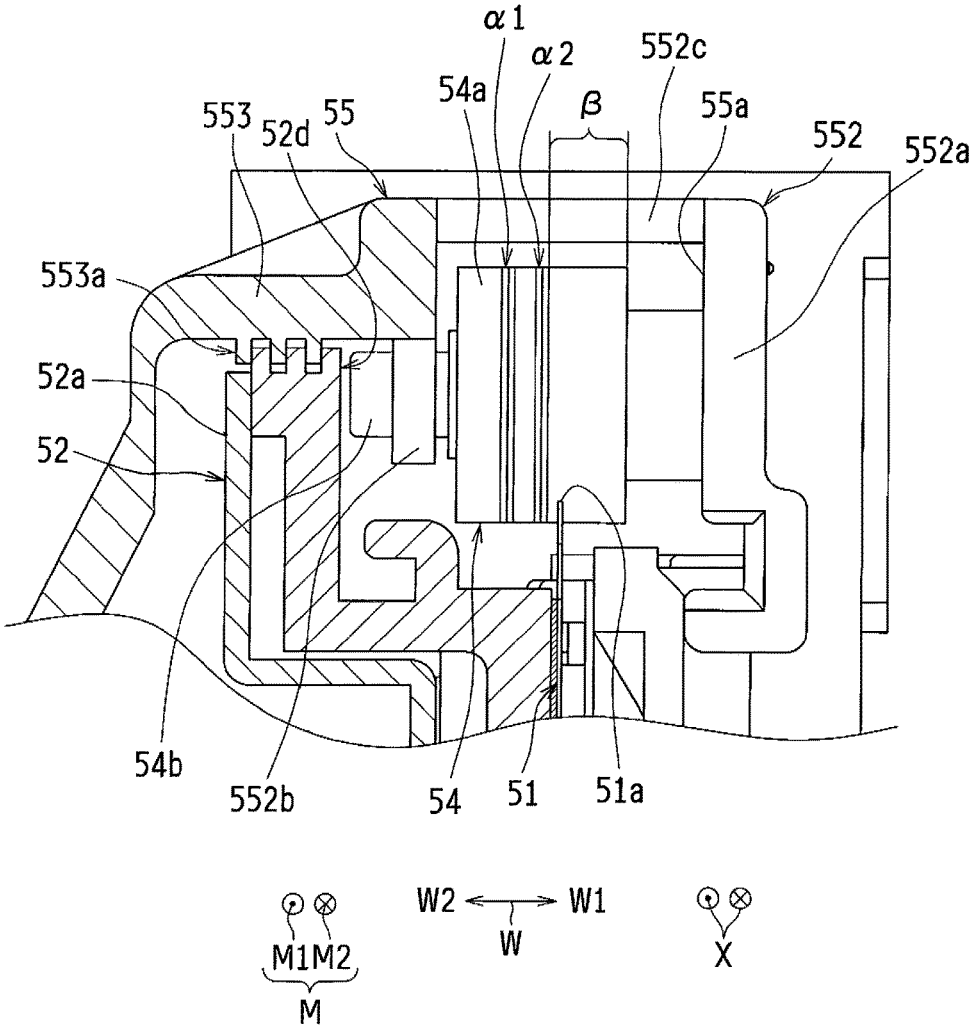
FIG. 17 is a schematic side view illustrating, on an enlarged scale, a site of engagement between a movable holding portion and a body portion in a charging device according to a fifth embodiment.

FIG. 17 is a schematic side view illustrating, on an enlarged scale, a site of engagement between a movable holding portion 55 and a body portion 52 in a charging device 5 according to a fifth embodiment.

The charging device 5 according to the fifth embodiment is configured such that a cleaning position at the surface 54*a* of the cleaning roller 54 according to each of the first to fourth embodiments can be changed to an unused portion β (see FIGS. 12A and 12B, 14A and 14B, and 17) (that is, a portion not used for cleaning). Note that FIG. 17 illustrates an example where the configuration of the fifth embodiment is applied to the configuration (see FIG. 10 and the like) of the first embodiment.

With the above-described configuration, a wider area at a surface 54*a* of a cleaning roller 54 can be used when the cleaning roller 54 cleans tip portions 51*a* of a corona electrode 51. This allows longer-term maintenance of the cleaning performance of the cleaning roller 54 for the corona electrode 51.

In the example, the movable holding portion 55 is configured such that a shift range for a cleaning position (α1 and α2) of the cleaning roller 54 can be shifted and moved in a direction orthogonal or substantially orthogonal to a movement direction M and such that the movable holding portion 55 is provided at the body portion 52 so as to be movable along the movement direction M.

In the above-described manner, change of the cleaning position (α1 and α2) to the unused portion β at the surface 54*a* of the cleaning roller 54 can be implemented with a simple configuration.

Specifically, in the charging device 5 according to the fifth embodiment, the movable holding portion 55 (a joining portion 553 in the example) is engaged so as to be slidable in the movement direction M with respect to the body portion 52 and be capable of being positionally adjusted in a stepwise manner in the direction orthogonal or substantially orthogonal to the movement direction M. In the example, an uneven portion 553*a* which extends along the movement direction M is provided at a part facing the body portion 52 of the joining portion 553, and an uneven portion 52*d* which extends along the movement direction M and engages with the uneven portion 553*a* in the joining portion 553 is provided at the body portion 52. Predetermined spaces (play) which allow the movable holding portion 55 to shift in the direction orthogonal or substantially orthogonal to the movement direction M are provided between a tubular portion 551 and a guide portion 521 and between the guide portion 521 and each of the support portions 52*b* and 52*c*. With the engagement of the uneven portion 553*a* in the joining portion 553 with the uneven portion 52*d* in the body portion 52, the movable holding portion 55 is slidably movable in the movement direction M while being guided by the uneven portion 52*d* and is capable of being positionally adjusted in a stepwise manner in the direction orthogonal or substantially orthogonal to the movement direction M.

Other Embodiments

Note that although the above-described embodiments are configured such that the cleaning roller 54 is automatically made to reciprocate along the movement direction M, the cleaning roller 54 may be manually made to reciprocate. The rotation axis direction W of the cleaning roller 54 and a direction intersecting the longitudinal direction N of the corona electrode 51 may be interchanged. Although the single cleaning roller 54 is used, a plurality of cleaning rollers 54 may be disposed along the longitudinal direction N of the corona electrode 51.

In the embodiments, a corona discharge device according to the present disclosure is applied to the charging device 5 that charges the photosensitive drum 3 to a predetermined potential. However, any type of charging device may be adopted as long as the charging device causes corona discharge. For example, the corona discharge device may be applied to, for example, a charging device which charges a surface of an intermediate transfer belt through corona charge.

The present disclosure is not limited to the above-described embodiments and may be embodied in other specific forms. The embodiments are therefore to be considered in all respects as illustrative and not restrictive. The scope of the present disclosure is indicated by the appended claims rather than the foregoing description. All modifications and changes which come within the meaning and range of equivalency of the claims are therefore intended to be embraced therein.

The present disclosure contains subject matter related to that disclosed in Japanese Priority Patent Application JP 2016-104261 filed in the Japan Patent Office on May 25, 2016, the entire contents of which are hereby incorporated by reference.

What is claimed is:

1. A corona discharge device comprising:

a corona electrode provided with multiple sharpened tip portions in a row; and a cleaning member which cleans the tip portions of the corona electrode while reciprocating along a predetermined movement direction set in advance with the tip portions biting into the cleaning member, wherein a cleaning position at a surface of the cleaning member is different in a direction intersecting a longitudinal direction of the corona electrode between when the cleaning member moves toward one side in the movement direction and when the cleaning member moves toward another side in the movement direction, and the cleaning member is a cleaning roller which rotates and cleans the tip portions of the corona electrode while reciprocating along the movement direction with the tip portions biting into the cleaning roller.

2. The corona discharge device according to claim 1, wherein a rotation axis direction of the cleaning roller and an orthogonal direction orthogonal to the longitudinal direction of the corona electrode intersect at a predetermined angle of inclination set in advance, and the cleaning position at the surface of the cleaning roller is shifted toward one side in the rotation axis direction through rotation of the cleaning roller in one rotation direction, and the cleaning position at the surface of the cleaning roller is shifted toward another side in the rotation axis direction through rotation of the cleaning roller in another rotation direction.

3. The corona discharge device according to claim 2, further comprising:

a body portion which supports the corona electrode; and a movable holding portion which holds the cleaning roller such that the cleaning roller is rotatable about a rotation axis and is provided to be reciprocable along the movement direction with respect to the body portion, wherein the cleaning roller is held by the movable holding portion to be shiftable along the rotation axis direction or the corona electrode is held by the body portion to be shiftable along the orthogonal direction.

4. The corona discharge device according to claim 2, wherein the longitudinal direction of the corona electrode is parallel or substantially parallel to the movement direction, and the rotation axis direction of the cleaning roller is inclined with respect to the movement direction.

5. The corona discharge device according to claim 2, wherein the longitudinal direction of the corona electrode is inclined with respect to the movement direction, and the rotation axis direction of the cleaning roller is at right angles or substantially at right angles to the movement direction.

6. The corona discharge device according to claim 1, wherein the cleaning roller has a structure with two layers, and one of the two layers is different in hardness from another layer.

7. The corona discharge device according to claim 6, wherein an outer layer of the two layers is a low-hardness layer and an inner layer is a high-hardness layer.

8. The corona discharge device according to claim 6, wherein the cleaning roller rotates and cleans the tip portions of the corona electrode while reciprocating along the movement direction with the tip portions biting into the inner layer.

9. The corona discharge device according to claim 1, wherein the cleaning position is changeable to an unused portion at the surface of the cleaning member.

10. An image formation apparatus comprising the corona discharge device according to claim 1.

11. A corona discharge device comprising:

a corona electrode provided with multiple sharpened tip portions in a row; and a cleaning member which cleans the tip portions of the corona electrode while reciprocating along a predetermined movement direction set in advance with the tip portions biting into the cleaning member, wherein a cleaning position at a surface of the cleaning member is different in a direction intersecting a longitudinal direction of the corona electrode between when the cleaning member moves toward one side in the movement direction and when the cleaning member moves toward another side in the movement direction, and the cleaning position is changeable to an unused portion at the surface of the cleaning member.

12. An image formation apparatus comprising the corona discharge device according to claim 11.

* * * * *